US005326689A

United States Patent [19]

Murayama

[11] Patent Number: 5,326,689

[45] Date of Patent: Jul. 5, 1994

[54] SILVER HALIDE PHOTOGRAPHIC MATERIAL

[75] Inventor: Masahiko Murayama, Minami Ashigara, Japan

[73] Assignee: Fuji Photo Film Co., Ltd., Kanagawa, Japan

[21] Appl. No.: 107,569

[22] Filed: Aug. 18, 1993

[30] Foreign Application Priority Data

Aug. 20, 1992 [JP] Japan ..... 4-221538
Aug. 11, 1993 [JP] Japan ..... 5-199704

[51] Int. Cl.[5] ..... G03C 1/85; G03C 1/86

[52] U.S. Cl. ..... 430/530; 430/532; 430/533; 430/349; 430/501; 430/930; 430/939; 430/527; 427/540; 422/907; 264/22

[58] Field of Search ..... 430/532, 530, 533, 349, 430/501, 930, 939, 527; 427/38; 422/907

[56] References Cited

U.S. PATENT DOCUMENTS

| | | | |
|---|---|---|---|
| 3,462,335 | 8/1969 | Hansen et al. | 156/273.3 |
| 3,761,299 | 9/1973 | Lidel | 427/547 |
| 4,072,769 | 2/1978 | Lidel | 427/38 |
| 4,141,735 | 2/1979 | Schrader et al. | 430/533 |
| 5,238,801 | 8/1993 | Ishigaki et al. | 430/530 |

*Primary Examiner*—Thomas R. Neville
*Attorney, Agent, or Firm*—Sughrue, Mion, Zinn, Macpeak & Seas

[57] ABSTRACT

A photographic material which exhibits excellent dynamic properties and little curl is provided. The silver halide photographic material comprises at least one light-sensitive layer on a polyester support, wherein the polyester support is a polyester support having a glass transition temperature of 90° C. to 200 ° C. and is subject to glow discharge treatment. The polyester support is preferably subjected to post heat treatment at a temperature ranging from 50 ° C. to lower than the glass transition temperature of said polyester support after the glow discharge treatment.

9 Claims, No Drawings

SILVER HALIDE PHOTOGRAPHIC MATERIAL

FIELD OF THE INVENTION

The present invention relates to a silver halide photographic material comprising a glow discharge-treated polyester having a glass transition temperature of 90° C. to 200° C. as a support.

BACKGROUND OF THE INVENTION

As the support for photographic light-sensitive materials there is generally used a fibrous polymer represented by triacetyl cellulose (hereinafter referred to as "TAC") or polyester polymer such as polyethylene terephthalate (hereinafter referred to as "PET").

In general, photographic light-sensitive materials are in the form of sheet film as in X-ray film, plate-making film and cut film or roll film as in color or black-and-white negative roll to be mounted in a cartridge having a width of 35 mm or less.

TAC to be used as the support for roll films exhibits a high transparency and an excellent decurlability after development.

On the other hand, PET films are excellent in mechanical strength and dimensional stability but are left much curled when unwound after development. This poor handleability puts restrictions on its application range despite its excellent properties.

In recent years, the photographic light-sensitive materials have found a variety of applications. For example, the reduction in the size of cameras, the increase in the film delivery speed upon picture taking and the increase in the magnification have been required. This requires a support having a high strength, a good dimensional stability and a small thickness.

Further, the reduction in the size of cameras accompanies a further demand for smaller cartridge.

In order to miniaturize the cartridge, two problems need to be solved.

One of the two problems is to inhibit the reduction in the dynamic strength accompanied by the reduction in the thickness of the film.

The other problem is a strong curl developed with time during storage due to the reduction in the size of the spool.

As an approach for reducing the curl of the polyester film there has been known a method as disclosed in JP-A-51-16358 (The term "JP-A" as used herein means an "unexamined published Japanese patent application") and U.S. Pat. No. 4,141,735.

As a surface treatment method for rendering the polyester support adhesive to the silver halide emulsion layer there may be used glow discharge treatment.

For the details of glow discharge treatment, reference can be made to U.S. Pat. No. 3,462,335, 3,761,299, and 4,072,769, and British Patent 891,469.

The polyester support can easily be electrically charged upon picture taking or when carried in an automatic developing machine. When discharged, it may cause fogging. The state-of-the-art antistatic method is disadvantageous in that since the material used elutes with the processing solution, the antistatic properties are eliminated after development. Thus, dust attached to the material due to electric charge appears on the print.

SUMMARY OF THE INVENTION

It is therefore an object of the present invention to provide a photographic material having a good adhesion between the emulsion layer and the support and an excellent dynamic strength.

It is another object of the present invention to provide a photographic material which exhibits little curl and excellent antistatic properties.

These and other objects of the present invention will become more apparent from the following detailed description and examples.

The foregoing objects of the present invention are accomplished with a silver halide photographic material comprising at least one light-sensitive layer on a polyester support, the polyester support is a glow discharge-treated polyester support having a glass transition temperature of 90° C. to 200° C.

DETAILED DESCRIPTION OF THE INVENTION

Tg of the polyester support to be used in the present invention is in the range of 90 ° C. to 200 ° C.

The polyester having such a Tg range is formed by the following dibasic acids and diols.

Examples of dibasic acids which can be used in the present invention include terephthalic acid, isophthalic acid, phthalic acid, phthalic anhydride, scuccinic acid, glutaric acid, adipic acid, sebasic acid, succinic anhydride, maleic acid, fumaric acid, maleic anhydride, iraconic acid, citraconic anhydride, tetrahydrophthalic anhydride, diphenylene-p,p'-dicarbonic acid, tetrachlorophthalic anhydride, 3,6-endomethylenetetrahydrophthalic anhydride, 1,4-cyclohexanedicarboxylic acid,

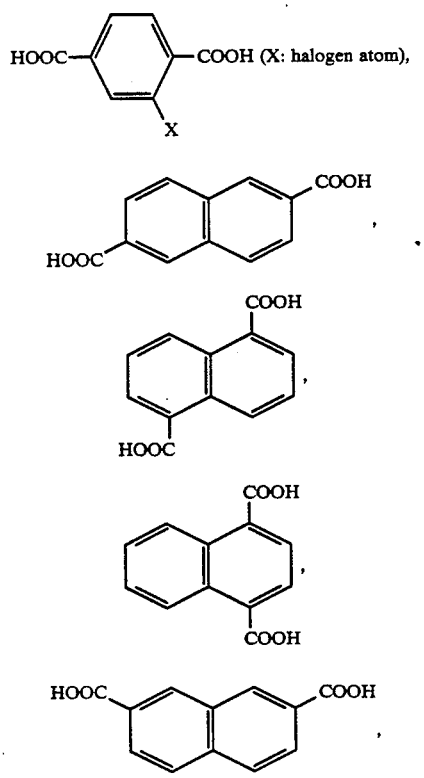

-continued

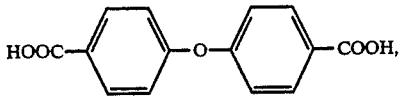

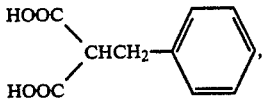

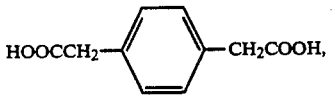

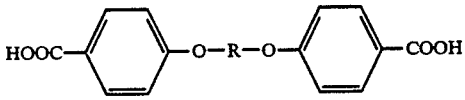

(R: $C_1 \sim C_5$ alkylene),

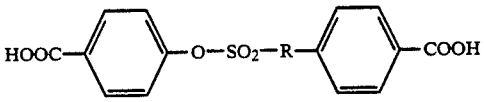

(R: $C_1 \sim C_5$ alkylene),

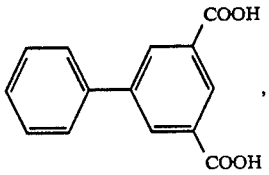

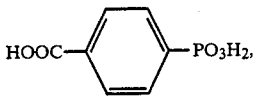

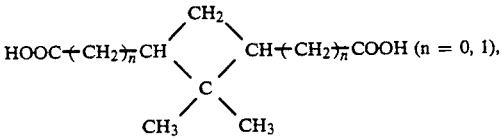

$HOOC-R-SO_2R-COOH$ (R: $C_3 \sim C_5$ alkylene),

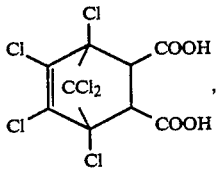

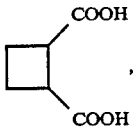

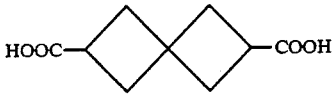

Examples of diols which can be used in the present invention include ethylene glycol, 1,3-propanediol, 1,2-propanediol, 1,4-butanediol, 1,5-pentanediol, 1,6-hexanediol, 1,7-heptanediol, 1,8-octanediol, 1,10-decanediol, 1,12-dodecanediol, 1,4-cyclohexanediol, 1,4-cyclohexanedimethanol, 1,3-cyclohexanediol, 1,1-cyclohexanedimethanol, catechol, resorcinol, hydroquinone, 1,4-benzenedimethanol,

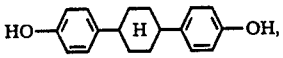

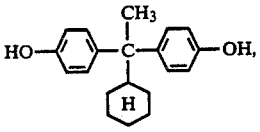

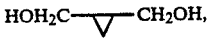

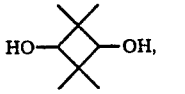

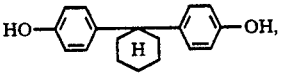

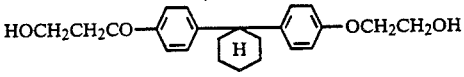

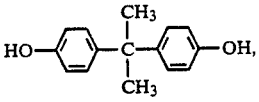

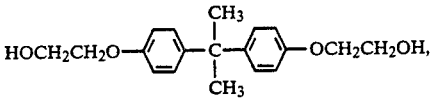

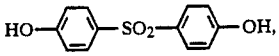

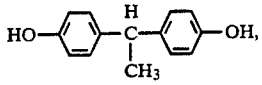

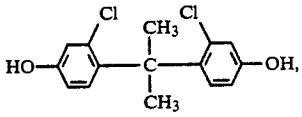

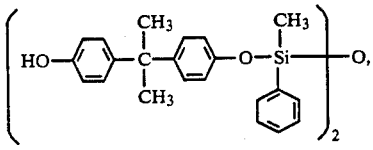

If necessary, a monofunctional or polyfunctional hydroxyl-containing compound having a functionality of 3 or more or a monofunctional or polyfunctionalacidcontaining compound may be copolymerized with the system.

In the polyester molecule of the present invention, a compound containing both a hydroxyl group and a carboxyl group (or its ester) may be copolymerized. Examples of such a compound include the following ones:

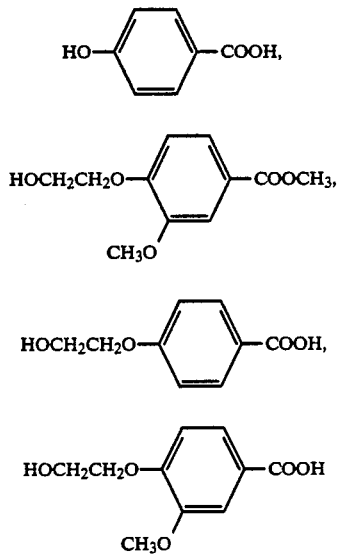

| | |
|---|---|
| PAr: [TPA/bisphenol A (BPA) (100/100)] | Tg = 192° C. |
| *Copolymer (figure in parenthesis indicates molar ratio) | |
| PBC-1 2,6-NDCA/TPA/EG (50/50/100) | Tg = 92° C. |
| PBC-2 2,6-NDCA/TPA/EG (75/25/100) | Tg = 102° C. |
| PBC-3 2,6-NDCA/TPA/EG/BPA (50/50/75/25) | Tg = 112° C. |
| PBC-4 TPA/EG/BPA (100/50/50) | Tg = 105° C. |
| PBC-5 TPA/EG/BPA (100/25/75) | Tg = 135° C. |
| PBC-6 TPA/EG/CHDM/BPA (100/25/25/50) | Tg = 115° C. |
| PBC-7 IPA/PPDC/TPA/EG (20/50/30/100) | Tg = 95° C. |
| PBC-8 NDCA/NPG/EG (100/70/30) | Tg = 105° C. |
| PBC-9 TPA/EG/BP (100/20/80 | Tg = 115° C. |
| PBC-10 PHBA/EG/TPA (200/100/100) | Tg = 125° C. |
| *Polymer blend (figure in parenthesis indicates weight proportion) | |
| PBB-1 PEN/PET (60/40) | Tg = 95° C. |
| PBB-2 PEN/PET (80/20) | Tg = 104° C. |
| PBB-3 PAr/PEN (50/50) | Tg = 142° C. |
| PBB-4 PAr/PCT (50/50) | Tg = 118° C. |
| PBB-5 PAr/PET (60/40) | Tg = 101° C. |
| PBB-6 PEN/PET/PAr (50/25/25) | Tg = 108° C. |

Specific examples of polyesters which can be used in the present invention include homopolymers such as polyethylene naphthalate (PEN), polyethylene terephthalate and polycyclohexanedimethanol terephthalate (PCT), those obtained by the copolymerization of, 2,6-naphthalenedicarboxylic acid (NDCA), terephthalic acid (TPA), isophthalic acid (IPA), orthophthalic acid (OPA), and biphenyl-4,4'-dicarboxylic acid (PPDC) as dicarboxylic acids, ethylene glycol (EG), cyclohexanedimethanol (CHDM), neopentyl glycol (NPG), bisphenol A (BPA), and biphenol (BP) as diols, and parahydroxybenzoic acid (PHBA) and 6-hydroxy-2-naphthalenecarboxylic acid (HNCA) as copolymerizable hydroxycarboxylic acids.

Preferred among these polyesters are copolymers such as copolymer of naphthalenedicarboxylic acid, terephthalic acid and ethylene glycol (mixing molar proportion of naphthalenedicarboxylic acid and terephthalic acid is preferably 0.3:0.7 to 1:0, more preferably 0.5:0.5 to 0.8:0.2), copolymer of terephthalic acid, ethylene glycol and bisphenol A (mixing molar proportion of ethylene glycol and bisphenol A is preferably 0.6:0.4 to 0:1, more preferably 0.5:0.5 to 0.1:0.9), copolymer of isophthalic acid, biphenyl-4,4'-dicarboxylic acid, terephthalic acid and ethylene glycol (molar proportion of isophthalic acid and biphenyl-4,4'-dicarboxylic acid to terephthalic acid as 1 are preferably 0.1 to 2 and 0.1 to 4, more preferably 0.1 to 1 and 0.1 to 2, respectively), copolymer of naphthalenedicarboxylic acid, neopentyl glycol and ethylene glycol (molar proportion of neopentyl glycol and ethylene glycol is preferably 1:0 to 0.7:0.3, more preferably 0.9:0.1 to 0.6:0.4), copolymer of terephthalic acid, ethylene glycol and biphenol (molar proportion of ethylene glycol and biphenol is preferably 0:1 to 0.8:0.2, more preferably 0.1:0.9 to 0.7:0.3 ) and copolymer of parahydroxybenzoic acid, ethylene glycol and terephthalic acid (molar proportion of parahydroxybenzoic acid and ethylene glycol is preferably 1:0 to 0.1:0.9, more preferably 0.9:0.1 to 0.2:0.8 ), and polymer blends such as blend of PEN and PET (composition ratio of PEN and PET is preferably 0.3:0.7 to 1:0, more preferably 0.5:0.5 to 0.8:0.2), and blend of PET and par (composition ratio of PET and par is preferably 0.6:0.4 to 0:1, more preferably 0.5:0.5 to 0.1:0.9).

PEN is most preferred among these polyesters. PEN exhibits a high dynamic strength, particularly elastic modulus, and a glass transition temperature as high as about 120° C.

These homopolymers and copolymers can be synthesized by any known polyester preparation method. For example, an acid component is allowed to undergo direct esterification reaction with with a glycol component to synthesize a homopolymer or copolymer. If a dialkylester is used as an acid component, it is allowed to undergo ester exchange reaction with a glycol component, and the reaction system is then heated under reduced pressure to remove excess glycol component to synthesize a homopolymer or copolymer. Alternately, the acid component may be reacted with a glycol component in the form of acid halide. In this case, the reaction may be effected in the presence of an ester exchange reaction catalyst or polymerization reaction catalyst or with a heat stabilizer added to the system. For the details of these polyester synthesis methods, reference can be made to "Kobunshi Jikkengaku (Experiment on High Molecular Compounds)", vol. 5 (Polycondensation and polyaddition), Kyoritsu Shuppan, 1980, pp. 103–136, and "Gosei Kobunshi (Synthetic High Molecular Compounds) V", Asakura Shoten, 1971, pp. 187–286.

The average molecular weight of these polyesters is preferably in the range of about 5,000 to 100,000.

The blend of polymers thus obtained can be easily formed in accordance with methods as disclosed in JP-A-49-5482, 64-4325, and 3-192718, and Research Disclosure Nos. 283,739-41, 284,779-82, and 294,807-14.

Specific examples of preferred polyesters to be used in the present invention will be given below, but the present invention should not be construed as being limited thereto.

| Examples of polyester compound | | |
|---|---|---|
| | *Homopolymer | |
| PEN: | [2,6-naphthalenedicarboxylic acid (NDCA)/ethylene glycol (EG) (100/100)] | Tg = 119° C. |
| PCT: | [terephthalic acid (TPA)/ cyclohexanedimethanol (CHDM) | Tg = 93° C. |

-continued

| Examples of polyester compound | | |
|---|---|---|
| | (100/100)] | |
| PAr: | [TPA/bisphenol A (BPA) (100/100)] | Tg = 192° C. |
| *Copolymer (figure in parenthesis indicates molar ratio) | | |
| PBC-1 | 2,6-NDCA/TPA/EG (50/50/100) | Tg = 92° C. |
| PBC-2 | 2,6-NDCA/TPA/EG (75/25/100) | Tg = 102° C. |
| PBC-3 | 2,6-NDCA/TPA/EG/BPA (50/50/75/25) | Tg = 112° C. |
| PBC-4 | TPA/EG/BPA (100/50/50) | Tg = 105° C. |
| PBC-5 | TPA/EG/BPA (100/25/75) | Tg = 135° C. |
| PBC-6 | TPA/EG/CHDM/BPA (100/25/25/50) | Tg = 115° C. |
| PBC-7 | IPA/PPDC/TPA/EG (20/50/30/100) | Tg = 95° C. |
| PBC-8 | NDCA/NPG/EG (100/70/30) | Tg = 105° C. |
| PBC-9 | TPA/EG/BP (100/20/80) | Tg = 115° C. |
| PBC-10 | PHBA/EG/TPA (200/100/100) | Tg = 125° C. |
| *Polymer blend (figure in parenthesis indicates weight proportion) | | |
| PBB-1 | PEN/PET (60/40) | Tg = 95° C. |
| PBB-2 | PEN/PET (80/20) | Tg = 104° C. |
| PBB-3 | PAr/PEN (50/50) | Tg = 142° C. |
| PBB-4 | PAr/PCT (50/50) | Tg = 118° C. |
| PBB-5 | PAr/PET (60/40) | Tg = 101° C. |
| PBB-6 | PEN/PET/PAr (50/25/25) | Tg = 108° C. |

The object of glow discharge treatment is to fulfill various requirements for the support to be treated, such as enhancement of adhesive properties and mar resistance and inhibition of yellowing, at the same time. For supports which have been obtained by subjecting polyethylene terephthalate support materials of the present invention to heat treatment at a temperature of from 50° C. to the glass transition temperature thereof, it is an important object to suppress blocking and yellowing (represented by the comparison of absorbance at 400 nm between before and after treatment) within a 7% increase from that before the heat treatment at the same time with the fulfillment of the other requirements.

The inventor found that glow discharge treatment is especially effective for the polyester support having a glass transition temperature of 90° C. to 200° C. of the present invention, while it is not considered that glow discharge treatment is especially effective for PET.

The glow discharge treatment may be conducted under arbitrary conditions effectively, but the glow discharge treatment is preferably conducted in the presence of water vapor. The glow discharge treatment efficiently provides sufficient adhesive properties in a short period of time, inhibiting yellowing.

Specifically, the percent partial pressure of water vapor in the presence of which the glow discharge treatment is conducted is preferably from 10% to 100%, more preferably 40% to 90% based on the treatment atmosphere. This is because that if this value falls below 10%, it is difficult to obtain sufficient adhesive properties. The gas other than water vapor is air containing oxygen, nitrogen, etc.

The quantitative introduction of water vapor into the atmosphere for glow discharge treatment can be accomplished by introducing the gas through a sampling tube mounted on the glow discharge treatment apparatus into a quadrupole type mass analyzer by which the composition of the gas is assayed.

In general, a glow discharge treatment is effected with various gases (e.g., oxygen gas, nitrogen gas, and argon gas) being introduced into the system. In the case of the heat-treated polyester support according to the present invention, the use of water vapor is the most efficient. The use of argon gas provides an enhancement of the adhesive properties, a relatively small worsening of yellowing and a relatively small drop of mar resistance but is disadvantageous in that argon gas is too expensive for industrial application.

On the contrary, the use of water vapor is industrially advantageous in that it exerts the same or better effects than the use of argon gas or helium gas and is very inexpensive. Those other than these gases may be used for the polyester according to the present invention, while gases useful for PET are limited.

The reason why the adhesive properties of the polyester support is enhanced by the glow discharge treatment in the presence of water vapor can be believed as follows. Specifically, it is thought that water molecules activated by the glow discharge treatment react with the polyester on the surface of the polyester support, facilitating the introduction of hydroxyl groups into the polyester molecules.

On the contrary, it is thought that when the glow discharge treatment is effected in the presence of oxygen, activated oxygen molecules cause carbonyl groups or ether groups to be formed on the polyester molecules on the surface of the polyester support. In the case of the support for photographic film according to the present invention, the material is normally coated with a hydrophilic polymer (e.g., gelatin) on the glow-discharged surface. Therefore, it is thought that hydroxyl group has a higher affinity for the hydrophilic polymer and can provide sufficient adhesive properties more easily than carbonyl or ether group. This probably can shorten the glow discharge treatment time, inhibiting yellowing or mar resistance drop.

The support which has been thus preheated is then subjected to glow discharge treatment. Important treatment conditions to be controlled other than partial pressure of water vapor and preheating temperature of support are degree of vacuum, voltage across electrodes, etc. By properly controlling these treatment conditions, the glow discharge treatment can be effected to provide sufficient adhesive properties and mar resistance at the same time.

The pressure under which the glow discharge treatment is effected is preferably from 0.005 to 20 Torr, more preferably 0.02 to 2 Torr. If the pressure is too low, the surface of the support cannot be sufficiently modified, making it impossible to obtain sufficient adhesive properties. On the other hand, if the pressure is too high, the surface destruction proceeds too far. Thus, as the molecular weight of the polyester molecules lowers, embrittlement proceeds, rendering the support surface brittle. This can easily cause a deterioration of adhesive properties and mar resistance.

The glow discharge voltage is preferably from 500 to 5,000 V, more preferably 500 to 3,000 V. If the voltage is too low, the surface of the support cannot be sufficiently modified, making it impossible to obtain sufficient adhesive properties. On the other hand, if the pressure is too high, the surface of the support is denatured, causing a drop of adhesive properties and mar resistance.

The support which has been thus subjected to glow discharge treatment is preferably immediately cooled by means of cooling roll. This is because that with the rise in the temperature the support to be treated is subject to plastic deformation due to external force that impairs the smoothness thereof or causes low molecular compounds (e.g., monomer, oligomer) to be deposited on the surface thereof and thus impairs the transparency thereof, making it impossible to put the material into practical use.

In the typical glow discharge treatment conditions, the percent partial pressure of water vapor in the treatment atmosphere is from 10% to 90%, the pressure is from 0.005 to 20 Torr, and the voltage across electrodes is from 500 V to 5,000 V.

The discharge frequency is in the range of 0 (direct current) to several hundreds of MHz, preferably 50 Hz to 20 MHz, more preferably 50 Hz to 1 MHz, as seen in the conventional technique.

The discharge treatment intensity may range from 0.01 KV·A·min./$m^2$ to 5 KV·A·min./$m^2$, preferably from 0.15 KV·A·min./$m^2$ to 1 KV·A·min./$m^2$, to provide a desired adhesivity.

The gas partial pressure in the vacuum tank is determined by measuring the gas composition from peaks appearing every mass in a specimen sampled from the gas in the tank via a quadrupole type mass spectrograph (MSQ-150 available from ULVAC Japan, Ltd.) directly connected to the vacuum tank.

The inventor further found that if the film is subject to glow discharge treatment at the preheated state, it may be treated for a shorter period of time than at ordinary temperature to provide improvements in the film surface properties such as adhesivity and hydrophilicity and the degree of yellow coloring of the film accompanied by the vacuum glow discharge treatment can be drastically reduced. The preheating temperature is preferably from 50° C. to Tg, more preferably 70° C. to Tg, further preferably 90° C. to Tg. If the preheating temperature is higher than Tg, it slightly deteriorates the adhesivity of the support.

Specific examples of the method for raising the temperature of the surface of the polymer in vacuo include heating by an infrared heater and heating by being brought into contact with a heat roll. For example, if the surface of the film is to be heated to a temperature of 115° C., the film has to only be brought into contact with a 115° C. heat roll for 1 second at most. The present invention is not limited to the foregoing heating methods, but various known heating methods can be used.

The present heat treatment for eliminating curl will be described hereinafter.

The minimum core diameter of the conventional 135 system is 14 mm. If the minimum core diameter of the conventional 135 system is reduced to 5 to 11 mm, even a polyester support of the present invention has a curl and thus finds difficulty in travel during the development procedure.

If the outer diameter of the core is less than 5 mm, the photographic emulsion undergoes pressure marking (fogging), making it impossible to further reduce the diameter of the spool.

The inventor found that if the polyester film of the present invention is subjected to heat treatment at a temperature of from 50° C. to lower than its glass transition temperature before the glow discharge treatment, it can get little curl. The inventor further found that the film can be better heat-treated at a temperature being gradually lowered from not less than Tg to less than Tg to get less curl.

The heat treatment at a temperature of 50° C. to less than Tg or the slow cooling from not less than Tg to less than Tg is called "post heat treatment" or "heat treatment (1)" herein. The heat treatment which is effected at a temperature of from Tg to Tg+130° C. prior to the post heat treatment is called "preheat treatment" or "heat treatment (2)".

In the present invention, it is preferred that the preheat treatment is conducted. The preheat treatment is effected at a temperature of Tg or more to fully destroy the crystalline structure of the polyester support. On the other hand, the preheating temperature exceeds Tg +130° C., the base generally exhibits an increased fluidity, giving difficulty in handleability. Accordingly, the preheat treatment is preferably effected at a temperature of from Tg to Tg+130° C., more preferably from Tg+10° C. to the crystallization point.

The preheat treatment time needs to be 0.1 minute or more. However, the preheat treatment time exceeds 1,500 hours, the base is disadvantageously colored. Accordingly, the preheat treatment time is preferably from 0.1 minute to 1,500 hours, more preferably from 1 minute to 1 hour.

The post heat treatment is preferably effected at a temperature of from 50° C. to less than Tg. The post heat treatment may be effected at a constant temperature or at a temperature being gradually lowered. More preferably, the post heat treatment is effected at a temperature being gradually lowered from not less than Tg to less than Tg as defined herein. The preferred time of the post heat treatment is 0.1 to 500 hours.

In the method for slow cooling from not less than Tg to less than Tg, the average cooling rate between Tg and Tg−40° C. is preferably from−0.01° C./min. to−20° C./min., more preferably from−0.01° C./min. to−5° C./min.

If DSC measurement is conducted with such a post heat treatment, an endothermic peak appears over Tg. The glass transition temperature (Tg) herein means the arithmetic mean of temperatures at which the deviation of 10 mg of a specimen film from its base line begins and temperatures at which the recovery thereof to a new base line is made during heating of the specimen film at a rate of 20° C./min. in a stream of nitrogen. The measurement is conducted by means of a differential scanning colorimeter.

When a film wound in the form of roll, there is developed a remarkable temperature difference between the core and the outer surface and between the edge and the central part of the support. For example, as the temperature rises, a biaxially-oriented polyester base shows some shrinkage that causes a crosswise periodic unevenness. Further, the biaxially-oriented polyester support is insuceptible to creep at an elevated temperature. This can cause a trouble called "core copy", i.e., support deformation copied after the unevenness on the core.

The present invention, which comprises preheat treatment followed by post heat treatment, can provide a curl reduction only by a heat treatment for about 20 minutes. Accordingly, if the polyester base is heat-treated during travel so that heat shrinkage is completed, it can be rendered free of unevenness even wound in the form of roll.

This heat treatment may be effected in a heat treatment zone disposed at the rear end of the film-forming machine or a drying zone in the undercoating procedure.

For example, a polyester support may be generally subjected to heat treatment called heat fixing at the end of the film-forming procedure. In this heat fixing, the polyester support is heated to a temperature near 200° C. The material may be once cooled to a predetermined temperature by cold air or cooling drum, and then passed through a heat treatment zone having a predetermined temperature gradient to effect the heat treatment of the present invention. This heat treatment may be effected by means of an infrared heater, high temperature steam, etc.

It is most preferred that this heat treatment be effected at a coating procedure such as the coating of undercoating layer and back layer. This is because that such a coating procedure has a long drying zone that can be also used by the heat treatment process of the present invention, resulting in a reduction in the facility investment.

The thickness of the support is preferably from 60 μm to 122 μm. In the photographic film, a hygroscopic gelatin layer is generally coated on the support to a thickness of 3 to 30 μm. When dried, this gelatin layer shrinks, producing a great shrinkage stress that causes the film to be deformed in the form of gutter. This gutter-shaped curl deteriorates the flatness required upon picture taking and printing and reduces the passability of the film. Thus, a support is required which is elastic high enough to withstand the shrinkage stress. At present, no polymers exist which can be formed into a transparent film and are elastic high enough to be thinned to less than 60 μm. On the other hand, 122 μm is a thickness that can be accomplished with TAC and is out of the reduction in the thickness of the support, which is one of the objects of the present invention. Accordingly, the thickness of the support is preferably from 60 μm to 122 μm.

An ultraviolet absorbent may be incorporated in these polymer films for the purpose of providing age stability. As such an ultraviolet absorbent, a compound which exhibits no absorption in the visible range is preferred. The amount of such an ultraviolet absorbent to be incorporated is normally in the range of 0.5% by weight to 20% by weight, preferably 1% by weight to 10% by weight based on the weight of the polymer film. If it falls below 0.5% by weight, the effect of inhibiting the ultraviolet deterioration cannot be expected. Examples of such an ultraviolet absorbent include benzophenone ultraviolet absorbents such as 2,4-dihydroxybenzophenone, 2-hydroxy-4-methoxybenzophenone, 2-hydroxy-4-n-octhoxybenzophenone, 4-dodecyloxy-2-hydroxybenzophenone, 2,2',4,4'-tetrahydroxybenzophenone and 2,2'-dihydroxy-4,4'-dimethoxybenzophenone, benzotriazole ultraviolet absorbents such as 2(2'-hydroxy-5-methylphenyl)benzotriazole, 2(2'-hydroxy-3',5'-di-t-butylphenyl)benzotriazole, and 2(2'-hydroxy-3'-di-t-butyl-5'-methylphenyl)benzotriazole, and salicylic ultraviolet absorbents such as phenyl salicylate and methyl salicylate.

The refraction index of a polyester, particularly aromatic polyester, is as high as 1.6 to 1.7. On the other hand, the refraction index of gelatin, which is a main component of the light-sensitive layer to be coated on the polyester support, is from 1.50 to 1.55, which is smaller than that of the polyester. Accordingly, rays which are incident upon the film edge is reflected by the interface of the base with the emulsion layer, causing a so-called light-piping (edge fogging).

As an approach for inhibiting such a light-piping phenomenon there have been known a method which comprises incorporating inactive inorganic grains in a film and a method which comprises incorporating a dye in a film. The latter method is preferred because it causes no remarkable worsening of film haze.

Referring to the dye to be used in the film dyeing, the color tone is preferably gray from the standpoint of general properties of photographic materials. Further, a dye having an excellent heat resistance in the film-forming temperature of polyester film and an excellent compatibility with polyester is preferred.

From the above mentioned standpoint, as such dyes there can be used commecial dyes for polyester such as Diaresin available from Mitsubishi Chemical Industries Ltd. and Kayaset available from Nippon Kayaku Co., Ltd. in admixture to accomplish the objects of the present invention.

The polyester film of the present invention can be provided with slipperiness depending on the application. To this end, an inactive inorganic compound may be incorporated in the polyester film or a surface active agent may be coated on the polyester film as an ordinary method.

As such inactive inorganic grains there may be exemplified grains of $SiO_2$, $TiO_2$, $BASO_4$, $CaCO_3$, talc, kaolin, etc. Besides the provision of slipperiness with external grains by incorporating inactive grains in the polyester synthesis reaction system, the provision of slipperiness with internal grains by allowing a catalyst or the like which has been incorporated in the system during the polymerization reaction of polyester to deposit may be used.

As such external grains there may be used $SiO_2$ grains, which exhibit a refraction index relatively close to that of polyester film. Alternately, internal grains which can be deposited in relatively small grain diameters may be preferably used.

Further, in the case of kneading, layers provided with a function may be preferably laminated to provide a higher film transparency. As such methods there may be exemplified coextrusion method by a plurality of extruders, feed blocks or multi manifold dies.

The most suitable antistatic agent (or electrically conductive material) to be used in the present invention comprises finely divided grains of one crystallizable metal oxide selected from the group consisting of ZnO, $TiO_2$, $SnO_2$, $Al_2O_3$, $In_2O_3$, $SiO_2$, MgO, BaO, $MoO_3$ and $V_2O_5$ or composite thereof. Particularly preferred among these materials is an electrically conductive material comprising $SnO_2$ as a main component and antimony oxide in an amount of about 5 to 20% and/or other components (e.g., silicon oxide, boron, phosphur). These finely divided grains of electrically conductive crystallizable oxides or composite thereof exhibit a volume resistivity of $10^7$ Ωcm or less, more preferably $10^5$ Ωcm or less. The grain size of these finely divided grains is preferably in the range of 0.002 to 0.7 μm, particularly 0.005 to 0.3 μm.

Such an electrically conductive layer containing the electrically conductive material may be on the silver halide emulsion layer side or on the back layer side of the support opposite the silver halide emulsion layer. The binder to be incorporated in the electrically conductive layer is not specifically limited and may be a water-soluble or organic-soluble binder or may be crosslinked as in latex.

The volume resistivity of the antistatic layer thus obtained is in the range of $10^3$Ω to $10^{12}$Ω, more preferably $10^3$ to $10^{10}$Ω, further preferably $10^3$Ω to $10^9$Ω.

Further, the silver halide photographic material of the present invention may comprise a magnetic recording layer to record various data. As ferromagnetic materials there may be used known compounds. The magnetic recording layer is preferably provided on the back side of the support. The magnetic recording layer may be provided by coating or printing. In order to record various data, the photographic light-sensitive material may be provided with a space for optical recording.

The photographic layer in the photographic material of the present invention will be described hereinafter.

The silver halide emulsion layer may be for color or black-and-white photographic materials. The description will be made hereinafter with reference to color silver halide photographic materials.

The present photographic material can comprise at least one blue-sensitive layer, at least one green-sesitive layer and at least one red-sensitive layer on a support. The number of silver halide emulsion layers and light-insensitive layers and the order of arrangement of these layers are not specifically limited. In a typical embodiment, the present silver halide photographic material comprises light-sensitive layers consisting of a plurality of silver halide emulsion layers having substantially the same color sensitivity and different light sensitivities on a support. The light-sensitive layers are unit light-sensitive layers having a color sensitivity to any of blue light, green light and red light. In the multi-layer silver halide color photographic material, these unit light-sensitive layers are normally arranged in the order of red-sensitive layer, green-sensitive layer and blue-sensitive layer as viewed from the support. However, the order of arrangement can be optionally reversed depending on the purpose of application. Alternatively, two unit light-sensitive layers having the same color sensitivity can be arranged with a unit light-sensitive layer having a different color sensitivity interposed therebetween.

Light-insensitive layers such as various interlayers can be provided between these silver halide light-sensitive layers and on the uppermost layer and lowermost layer.

These interlayers can comprise couplers, DIR compounds or the like as described in JP-A-61-43748, 59-113438, 59-113440, 61-20037 and 61-20038. These interlayers can further comprise a color stain inhibitor as commonly used.

The plurality of silver halide emulsion layers constituting each unit light-sensitive layer are disclosed in West German Patent 1,121,470, British Patent 923,045, JP-A-57-112751, 62-200350, 62-206541, 62-206543, 56-25738, 62-63936, and 59-202464, and JP-B-55-34932, and 49-15495 (The term "JP-B" as used herein means an "examined Japanese patent publication").

Silver halide grains may be so-called regular grains having a regular crystal form, such as cube, octahedron and tetradecahedron, or those having an irregular crystal form such as sphere and tablet, those having a crystal defect such as twinning plane, or those having a combination of these crystal forms.

The silver halide grains may be either fine grains of about 0.2 μm or smaller in diameter or giant grains having a projected area diameter or up to about 10 μm. The emulsion may be either a monodisperse emulsion or a polydisperse emulsion.

The preparation of the silver halide photographic emulsion which can be used in the present invention can be accomplished by any suitable method as described in Research Disclosure No. 17643 (December 1978), pp. 22–23, "I. Emulsion Preparation and Types", and No. 18716 (November 1979), page 648, Glafkides, "Chimie et Physique Photographique", Paul Montel (1967), G. F. Duffin, "Photographic Emulsion Chemistry", Focal Press, 1966, and V. L. Zelikman et al., "Making and Coating Photographic Emulsion Focal Press", 1964.

Furthermore, monodisperse emulsions as described in U.S. Pat. Nos. 3,574,628 and 3,655,394, and British Patent 1,413,748 can be preferably used in the present invention.

Tablet grains having an aspect ratio of about 5 or more can be used in the present invention. The preparation of such tablet grains can be easily accomplished by any suitable method as described in Gutoff, "Photographic Science and Engineering", vol. 14, pp. 248–257, 1970, U.S. Pat. Nos. 4,434,226, 4,414,310, 4,433,048, and 4,439,520, and British Patent 2,112,157.

The individual silver halide crystals may have either a homogeneous structure or a heterogeneous structure composed of a core and an outer shell differing in halogen composition, or may have a layered structure. Furthermore, the grains may have fused thereto a silver halide having a different halogen composition or a compound other than silver halide, e.g., silver thiocyanate, lead oxide, etc. by an epitaxial junction.

Mixtures of grains having various crystal forms may also be used.

The silver halide emulsion to be used in the present invention is normally subjected to physical ripening, chemical ripening and spectral sensitization. Additives to be used in these steps are described in Research Disclosure Nos. 17643 and 18716 as tabulated below.

Known photographic additives which can be used in the present invention are also described in the above cited two Research Disclosures as tabulated below.

| Kind of additive | RD17643 | RD18716 |
|---|---|---|
| 1. Chemical sensitizer | p. 23 | p. 648 right column (RC) |
| 2. Sensitivity increasing agent | | p. 648 RC |
| 3. Spectral sensitizer and supersensitizer | pp. 23–24 | p. 648 RC–p. 649 RC |
| 4. Brightening agent | p. 24 | |
| 5. Antifoggant and stabilizer | pp. 24–25 | p. 649 RC |
| 6. Light absorbent, filter dye, and ultraviolet absorbent | pp. 25–26 | p.649 RC–p.650 LC |
| 7. Stain inhibitor | p. 25 RC | p. 650 LC–RC |
| 8. Dye image stabilizer | p. 25 | |
| 9. Hardening agent | p. 26 | p. 651 LC |
| 10. Binder | p. 26 | p. 651 LC |
| 11. Plasticizer and lubricant | p. 27 | p. 650 RC |
| 12. Coating aid and surface active agent | pp. 26–27 | p. 650 RC |

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the photographic material.

The photographic material to be processed in the present invention can comprise various color couplers. Specific examples of the color couplers are described in the patents described in the above cited Research Disclosure No. 17643, VII-C to G.

Preferred yellow couplers include those described in U.S. Pat. Nos. 3,933,501, 4,022,620, 4,326,024, 4,401,752, 4,248,961, 3,973,968, 4,314,023, and 4,511,649, JP-B-58-10739, British Patents 1,425,020 and 1,476,760, and European Patent 249,473A.

Preferred magenta couplers include 5-pyrazolone compounds and pyrazoloazole compounds. Particularly preferred are those described in U.S. Pat. Nos. 4,310,619, 4,351,897, 3,061,432, 3,725,067, 4,500,630, 4,540,654, and 4,556,630, European Patent 73,636, JP-A-60-33552, 60-43659, 61-72238, 60-35730, 55-118034, and 60-185951, RD Nos. 24220 (June 1984) and 24230 (June 1984), and WO88/04795.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,753,871, 4,451,559, 4,427,767, 4,690,889, 4,254,212, and 4,296,199, West German Patent Disclosure No. 3,329,729, European Patents 121,365A and 249,453A, and JP-A-61-42658.

Colored couplers for correction of unnecessary absorptions of the developed dye preferably include those described in Research Disclosure No. 17643, VII-G, U.S. Pat. Nos. 4,163,670, 4,004,929, and 4,138,258, JP-B-57-39413, and British Patent 1,146,368.

Couplers which form a dye having moderate diffusibility preferably include those described in U.S. Pat. No. 4,366,237, British Patent 2,125,570, European Patent 96,570, and West German Patent Publication No. 3,234,533.

Typical examples of polymerized dye-forming couplers are described in U.S. Pat. Nos. 3,451,820, 4,080,211, 4,367,282, 4,409,320, and 4,576,910, and British Patent 2,102,137.

Compounds capable of releasing a photographically useful residue upon coupling can also be used in the present invention. Preferred examples of DIR couplers which release a development inhibitor are described in the patents cited in RD 17643, VII-F, JP-A-57-151944, 57-154234, 60-184248, and 63-37346, and U.S. Pat. No. 4,248,962.

Couplers capable of imagewise releasing a nucleating agent or a developing accelerator at the time of development preferably include those described in British Patents 2,097,140 and 2,131,188, and JP-A-59-157638 and 59-170840.

In addition to the foregoing couplers, the photographic material according to the present invention can further comprise competing couplers as described in U.S. Pat. No. 4,130,427, polyequivalent couplers as described in U.S. Pat. Nos. 4,283,472, 4,338,393, and 4,310,618, DIR redox compounds releasing couplers, DIR couplers releasing couplers, DIR coupler-releasing redox compounds, or DIR redox releasing redox compounds as described in JP-A-60-185950 and 62-24252, couplers capable of releasing a dye which returns to its original color after release as described in European Patents 173,302A, bleach accelerator-releasing couplers as disclosed in RD Nos. 11449 and 24241, and JP-A-61-201247, couplers capable of releasing a ligand as described in U.S. Pat. No. 4,553,477, and couplers capable of releasing a leuco dye as described in JP-A-63-75747.

The incorporation of the couplers of the present invention in the light-sensitive material can be accomplished by any suitable known dispersion method.

Examples of high boiling solvents to be used in the oil-in-water dispersion process are described in U.S. Pat. No. 2,322,027.

Specific examples of high boiling organic solvents having a boiling point of 175° C. or higher at normal pressure which can be used in the oil-in-water dispersion process include phthalic esters, phosphoric or phosphonic esters, benzoic esters, amides, alcohols or phenols, aliphatic carboxylic esters, aniline derivatives, and hydrocarbons. As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of latex dispersion method and specific examples of latexes to be used in dipping are described in U.S. Pat. No. 4,199,363, West German Patent Application (OLS) 2,541,274, and 2,541,230.

In the present light-sensitive material, the total thickness of all hydrophilic colloidal layers on the emulsion side is preferably in the range of 28 μm or less. The film swelling $T_{\frac{1}{2}}$ is preferably in the range of 30 seconds or less, more preferably 20 seconds or less. In the present invention, the film thickness is determined after being stored at a temperature of 25° C. and a relative humidity of 55% for 2 days. The film swelling $T_{\frac{1}{2}}$ can be determined by a method known in the art, e.g., by means of a swellometer of the type as described in A. Green et al., "Photographic Science and Engineering", vol. 19, No. 2, pp. 124–129. $T_{\frac{1}{2}}$ is defined as the time taken until half the saturated film thickness is reached wherein the saturated film thickness is 90% of the maximum swollen film thickness reached when the photographic material is processed with a color developer at a temperature of 30° C. over 195 seconds.

The film swelling $T_{\frac{1}{2}}$ can be adjusted by adding a film hardener to gelatin as binder or altering the ageing condition after coating. The percentage swelling of the photographic material is preferably in the range of 150 to 400%. The percentage swelling can be calculated from the maximum swollen film thickness determined as described above in accordance with the equation: (maximum swollen film thickness−film thickness)/film thickness.

The color photographic material according to the present invention can be developed in accordance with an ordinary method as described in RD Nos. 17643 (pp. 28–29), and 18716 (left column - right column on page 651).

The silver halide color photographic material of the present invention may contain a color developing agent for the purpose of simplifying and expediting processing. Such a color developing agent is preferably used in the form of various precursors. Examples of such precursors include indoaniline compounds as described in U.S. Pat. No. 3,342,597, Schiff's base type compounds as described in U.S. Pat. No. 3,342,599, and Research Disclosure Nos. 14,850 and 15,159, and compounds as described in Research Disclosure No. 13,924.

The present invention wily be further described in the following examples, but the present invention should not be construed as being limited thereto.

EXAMPLES

The curling degree measuring method and the related terminologies referred to hereinafter are defined below.

(1) Core setting:

This is to wind a film around a spool for curling it.

(2) Core set curl:

This means the lengthwise direction curl of a film made by core setting. The curling degree is measured by test method A of ANSI/ASC pH1.29-1985 and is represented as 1/R (m) (in which R indicates the radius of the curl).

(3) Absolute core set curl:

This indicates the core set curl of a photographic film to which no improvement in reducing the curl has been applied.

(4) Controlled core set curl:

This indicates the core set curl of a photographic film to which an improvement in reducing the curl has been applied.

(5) True core set curl:

This is represented by (absolute core set curl)−(controlled core set curl).

(6) Percent curl reduction:

This is represented by [(true core set curl)/(absolute core set curl)]×100

The photographic film specimens prepared in the following examples were evaluated as follows.

a) Core set curl

The film specimen was cut into a 1.2 m long and 35-mm wide strip. The specimen was then allowed to stand at a temperature of 25° C. and a relative humidity of 60% over night. The specimen was then wound around a spool having a diameter of 4 to 12 mm with its light-sensitive layer inside. The specimen was enclosed in a container, and then heated to a temperature of 80° C. for 2 hours to get curl. This temperature condition is based on the supposition that the film is left inside a car in the summerseason.

b) Development (Processing)

The film thus curled was then allowed to cool in a 25° C. room over night. The film specimen was withdrawn from the sealed container, processed in an automatic processor (Minilabo FP-560B, available from Fuji Photo Film Co., Ltd.).

The development conditions are set forth below. The speciment used for measurement was processed with a processing solution which had been used for running processing of a specimen which had been imagewise exposed until the color developer was replenished three times the tank capacity.

| Processing step | Temperature | Time |
|---|---|---|
| Color development | 38° C. | 3 min. |
| Bleach | 38° C. | 2 min. |
| Fixing | 38° C. | 3 min. |
| Rinsing | 38° C. | 3 min. |
| Stabilization | 38° C. | 0.5 min. |

The various processing solutions used had the following compositions:

| | |
|---|---|
| Color developer | |
| Caustic soda | 2 g |
| Sodium sulfite | 2 g |
| Potassium bromide | 0.4 g |
| Sodium chloride | 1 g |
| Borax | 4 g |
| Hydroxylamine sulfate | 2 g |
| Disodium ethylenediaminetetraacetate dihydrate | 2 g |
| 4-Amino-3-methyl-N-ethyl-N-(β-hydroxyethyl) aniline monosulfate | 4 g |
| Water to make | 1 l |
| Bleaching solution | |
| Ferric (III) sodium ethylenediamine-tetraacetate dihydrate | 100 g |
| Potassium bromide | 50 g |
| Ammonium nitrate | 50 g |
| Boric acid | 5 g |
| Aqueous ammonia to adjust pH to | 5.0 |
| Water to make | 1 l |
| Fixing solution | |
| Sodium thiosulfate | 150 g |
| Sodium sulfite | 15 g |
| Borax | 12 g |
| Glacial acetic acid | 15 ml |
| Potassium alum | 20 g |
| Water to make | 1 l |
| Stabilizing bath | |
| Boric acid | 5 g |
| Sodium citrate | 5 g |
| Sodium metaborate tetrahydrate | 3 g |
| Potassium alum | 15 g |
| Water to make | 1 l |

c) Curl after development

After development, the curling degree of the film specimen is measured by test method A of ANSI/ASC PH1.29-1985 and is represented as 1/R (m) (in which R indicates the radius of the curl) by means of a curling plate at a temperature of 25° C. and a relative humidity of 60%.

d) Development trouble (Unevenness)

After processed in an automatic processor (Minilabo FP-560B), the film specimen are visually evaluated as follows.

The criterion of evaluation of unevenness is based on the following three degrees:

E: It is uniformly processed.

F: Unevenness is slightly observed on the processed film but no unevenness is observed on the image printed therefrom, that is, it has no problem for practical use.

P: Unevenness is observed not only on the processed film but also on the image printed therefrom.

e) Development trouble (break or film rear end break after development)

After processed in an automatic processor (Minilabo FP-560B), the film specimen are visually evaluated as follows.

The criterion of evaluation of unevenness is based on the following three degrees:

E: No break

F: Some breaks are present but do not obstruct the conveying on printing, resulting in a normal print image.

P: Breaks are present such that they obstruct the conveying on printing.

f) Gutter-shaped curl

The specimen on which a light-sensitive layer had been coated was cut into a 35-mm wide and 1.2-m long strip. The specimen was then allowed to stand at a temperature of 25° C. and a relative humidity of 10% over night. The specimen was put on a flat table with the light-sensitive layer downward. The height of the specimen was measured by means of a vernier caliper. In Table 5-2 of Example 3, with Reference B as a reference type, those showing a greater value than that of Reference B were evaluated poor (P) while those showing the same or smaller value than that of Reference B were evaluated excellent (E).

g) Pressure marking

The specimen coated with up to a light-sensitive layer was cut into a 35-mm wide and 1.2-m long strip. The specimen was wound around the spool having a diameter indicated in Table 5-2, allowed to stand for 30 minutes, developed in accordance with the foregoing development method, and then visually evaluated for fogging. Those showing fogging were evaluated poor (P) while those showing no fogging were evaluated excellent (E).

h) Evaluation of dry adhesion

The specimen is cut on the emulsion side and back side with a razor in such a manner that 6 lines run 5 mm apart from each other horizontally and vertically to make 25 squares. An adhesive tape (Nitto Tape, available from Nitto Electric Industry Co., Ltd.) is then put on the surface of the specimen. The adhesive tape is quickly peeled off at an angle of 180 degree. Those showing no peel are considered A grade, those having an area left unpeeled in a proportion of 95% or more are considered B grade, those having an area left unpeeled in a proportion of 90% or more are considered C grade, those having an area left unpeeled in a proportion of 60% or more are considered D grade, and those having an area left unpeeled in a proportion of less than 60% or more are considered E grade. The adhesive strength grades which are practical enough for photographic materials are A and B grades.

i) Evaluation of wet adhesion

The film specimen is scratched and marked X on the emulsion layer side and back layer side with a steel pen in the processing solution at the various processing stages, i.e., color development, fixing and stabilization. The film specimen is then vigorously rubbed with a rubber-sheathed finger five times. For the evaluation of adhesive strength, the maximum width of the areas peeled along the line of X mark is determined.

Those showing areas on the emulsion layer and back layer peeled to an extent less than the scratch are considered A grade, those showing a maximum peel width of 2 mm or more are considered B grade, those showing a maximum peel width of 5 mm or less are considered C grade, and those showing a maximum peel width of more than 5 mm are considered D grade. The adhesive strength grade which is practical enough for photographic materials is A grade.

j) Static mark test

The specimen which has not been exposed is allowed to stand at a temperature of 25° C. and a relative humidity of 10% for 6 hours. In order to see what static marks the specimen develops with various materials, the specimen is rubbed with a rubber roller and an urethane roller in a darkroom under the same air conditions, processed in an automatic processor (Minilabo FP-560B) and then examined for static mark.

The criterion of evaluation of static mark is based on the following four degrees:

A: No static marks observed;

B: Slight static mark observed;

C: Significant static marks observed; and

D: Static marks observed on substantially the entire surface

The degree of static mark which is practical enough for photographic materials is A grade.

k) Dust Attraction

The film specimen (20 cm×20 cm) which has been undeveloped and the film specimen (20 cm×20 cm) which has been developed are vigorously rubbed with nylon at a temperature of 25° C. and a relative humidity of 10%, and then examined for attraction of tobacco ash. The criterion of evaluation is based on the following four degrees:

A: No dust attraction observed;

B: Slight dust attraction observed;

C: Significant dust attraction observed; and

D: Vigorous dust attraction observed

The degree of dust attraction which is practical enough for photographic materials is A grade.

EXAMPLE 1

1) Preparation of support

PET chips and PEN chips were each melt-extruded. The material was then lengthwise oriented by a factor of 3.4 and crosswise oriented by a factor of 4 to prepare a 80-μm thick biaxially-oriented polyester film. The lengthwise orientation zone had an infrared radiation heater installed as an auxiliary heating source on one side (side to be brought into contact with the casting drum upon casting, hereinafter referred to as "CD side").

During the film preparation, PEN was treated at an extrusion temperature of 300° C., a lengthwise orientation temperature (CD side) of 140° C., a crosswise orientation temperature of 130° C. and a heat fixing temperature of 250° C. (6 seconds).

On the other hand, PET was treated at an extrusion temperature of 270° C., a lengthwise orientation temperature (CD side) of 100° C., a crosswise orientation temperature of 110° C. and a heat fixing temperature of 220° C. (6 seconds).

TABLE 1

| Specimen No. | Support | Thickness (μm) | Glass transition temperature °C. | Lengthwise orientation temperature °C. CD side | Heat treatment °C. 24 hrs |
|---|---|---|---|---|---|
| A-1 (comparative) | PEN | 80 | 119 | 140 | None |
| A-2 (present invention) | " | " | " | " | 110 |
| A-3 (comparative) | " | " | " | " | 125 |
| A-4 (present invention) | " | " | " | " | 55 |
| A-5 (comparative) | " | " | " | " | 45 |
| A-6 (comparative) | " | " | " | " | 110 |
| A-7 (present invention) | " | " | " | " | 110 |
| B-1 (comparative) | PET | " | 69 | 100 | None |
| B-2 (comparative) | " | " | " | " | 60 |
| B-3 (comparative) | " | " | " | " | 80 |

TABLE 2

| Specimen No. | Glow discharge treatment | Presence of metal oxide in 1st back layer | Curl after development | % Curl reduction | Development trouble: Unevenness | Development trouble: Break | Adhesion: Dry | Adhesion: Wet | Antistatic properties: Static mark | Antistatic properties: Dust attraction |
|---|---|---|---|---|---|---|---|---|---|---|
| A-1 (Comparative) | Done | Yes | 125 | — | E | P | A | A | A | A |
| A-2 (present invention) | " | " | 44 | 65 | E | E | A | A | A | A |

TABLE 2-continued

| Specimen No. | Glow discharge treatment | Presence of metal oxide in 1st back layer | Curl after development | % Curl reduction | Development trouble: Uneven-ness | Development trouble: Break | Adhesion: Dry | Adhesion: Wet | Antistatic properties: Static mark | Antistatic properties: Dust attraction |
|---|---|---|---|---|---|---|---|---|---|---|
| A-3 (Comparative) | " | " | 123 | 2 | E | P | A | A | A | A |
| A-4 (present invention) | " | " | 55 | 56 | E | E | A | A | A | A |
| A-5 (Comparative) | " | " | 122 | 2 | E | P | A | A | A | A |
| A-6 (Comparative) | None | " | 44 | 65 | E | E | C | C | A | A |
| A-7 (present invention) | Done | No | 44 | 65 | E | E | A | A | D | D |
| B-1 (Comparative) | " | Yes | 210 | — | P | P | A | A | A | A |
| B-2 (Comparative) | " | " | 160 | 24 | F | P | A | A | A | A |
| B-3 (Comparative) | " | " | 210 | 0 | P | P | A | A | A | A |

The film thus formed tends to be curled with its low temperature side inside.

2) Heat treatment and surface treatment of support

The films obtained by the above mentioned method were each subjected to heat treatment under the conditions as set forth in Table 1. The heat treatment was effected on the film wound around a 30-cm diameter core with its undercoating side outside.

As comparative specimens, Specimens A-1 and B-1 were prepared free from heat treatment.

Thereafter, Supports A-1 to A-5, A-7 and B-1 to B-3 were each subjected to glow discharge treatment on both sides thereof under a reduced pressure of 0.2 mm Hg at an output of 2,500 W and an intensity of 0.5·KV·A·min/$m^2$.

For comparison, Specimen A-6, which had been formed from PEN in the same manner as above, extruded at a temperature of 300° C., lengthwise oriented at a temperature of 140° C. (CD side) and crosswise oriented at a temperature of 130° C., and then heat-fixed at a temperature of 250° C. for 6 seconds, was free from glow discharge treatment.

3) Coating of undercoating layer (emulsion layer side)

On the supports was coated an undercoating solution having the following composition in an amount of 10 ml/$m^2$. The materials were each dried at a temperature of 115° C. for 6 minutes.

| | |
|---|---|
| Gelatin | 1.0 parts by weight |
| Salicylic acid | 0.3 parts by weight |
| Resorcinol | 1.0 part by weight |
| Compound G | 0.05 parts by weight |
| Polyoxyethylenenonylphenyl ether (polymerization degree: 10) | 0.1 part by weight |
| Water | 2.2 parts by weight |
| Methanol | 95.35 parts by weight |

Compound G $$HO-CO\{(CH_2)_4CONH(CH_2)_2N(CH_2)_2NH\}_4HCl^{-}$$
$$H^{+}$$
$$CH_2CHCH_2Cl$$
$$OH$$

4) Coating of back layer

Back layers having the following composition were coated on the side of the undercoated supports opposite the undercoating layer.

(4-1) Preparation of dispersion of finely divided electrically conductive grains (dispersion of tine oxide-antimony oxide composite).

230 parts by weight of stannic chloride hydrate and 23 parts by weight of antimony trichloride were dissolved in 3,000 parts by weight of ethanol to make a uniform solution. A 1 N sodium hydroxide solution was added dropwise to the solution until the pH value of the solution reached 3 to obtain a coprecipitate of colloidal stannic oxide and antimony oxide. The coprecipitate thus obtained was then allowed to stand at a temperature of 50° C. for 24 hours to obtain a reddish-brown colloidal precipitate. The average grain diameter of the grains was 0.05 μm.

The reddish-brown colloidal precipitate was then subjected to centrifugal separation. The precipitate thus separated was then washed with water by centrifugal separation to remove excess ions. This procedure was repeated three times to remove excess ions.

200 parts by weight of the colloidal precipitate from which excess ions had been removed were re-dispersed in 1,500 parts by weight of water. The dispersion was then sprayed into a calcining furnace heated to a temperature of 500° C. to obtain finely divided bluish grains of stannic oxide/antimony oxide composite having an average grain diameter of 0.005 μm. The fine powder thus obtained exhibited a resisitivity of 25 Ω·cm.

A mixture of 40 parts by weight of the fine powder and 60 parts by weight of water was adjusted to a pH value of 7.0. The solution was then roughly dispersed by an agitator. The solution was then dispersed by a horizontal sand mill (Dinomill available from Willy A. Backfen AG) until the residence time reached 30 minutes. The dispersion exhibited an average grain diameter of 0.15 μm as calculated in terms of secondary particle agglomerate.

(4-2) Coating of antistatic layer

A layer having the following composition was coated on the support to a dry thickness of 0.2 μm. The material was then dried at a temperature of 115° C. for 30 seconds. (It was confirmed that the inner temperature of the casing and the substantial temperature of the conveying roller in the conveying system had been 115° C.)

| | |
|---|---|
| Dispersion of finely divided electrically conductive grains ($SnO_2/Sb_2O_3$; 0.10 μm) | 10 parts by weight |
| Gelatin | 1 part by weight |
| Water | 27 parts by weight |
| Methanol | 60 parts by weight |
| Resorcinol | 2 parts by weight |
| Polyoxyethylenenonylphenyl ether (polymerization degree: 10) | 0.01 parts by weight |

(4-3) Coating of back layer

A back layer dispersion having the following composition was prepared with diacetyl cellulose as a binder.

| | |
|---|---|
| Silicon dioxide (average grain diameter: 0.3 μm) | 0.01 parts by weight |
| Aluminum oxide | 0.03 parts by weight |
| Diacetyl cellulose | 1.0 part by weight |
| Methyl ethyl ketone | 9.4 parts by weight |
| Cyclohexanone | 9.4 parts by weight |
| Polyoxyethyleneparanonylphenol ether (polymerization degree: 10) | 0.06 parts by weight |
| Trimethylolpropane/3-toluenediisocyanate adduct | 0.03 parts by weight |
| Colloidal silica (aerogel, average grain diameter: 0.02 μm) | 0.02 parts by weight |
| $C_8F_{17}SO_2N(CH_3)(CH_2CH_2O)_6H$ | 0.01 parts by weight |
| Poly(vinylidene bifluoride/vinylidene tetrafluoride) (molar ratio: 9:1) | 0.01 parts by weight |
| Poly(methyl methacrylate/divinylbenzene) (molar ratio: 9:1, average grain diameter: 1.0 μm) | 0.01 parts by weight |

The dispersion was effected at 2,000 rpm for 2 hours by means of a sand grinder. As dispersion media there were used glass beads.

To the solution thus obtained was added a toluene diisocyanate in an amount of 30% based on the weight of binder. The material was then coated on the antistatic layer previously coated by means of a bar coater in a coated amount of 0.3 g/m$^2$ as calculated in terms of solid diacetyl cellulose content, and then dried at a temperature of 115° C. for 3 minutes. (It was confirmed that the inner temperature of the casing and the substantial temperature of the conveying roller in the conveying system had been 115° C.)

(4-4) Coating of slip layer

Preparation of lubricant dispersion

The two following lubricants were mixed in a proportion of 4:1. To the mixture was then added xylene in the same amount. The material was then dissolved at an elevated temperature of 100° C. To the solution was added isopropanol at room temperature at a time in an amount 10 times that of the lubricant solution under stirring with ultrasonic vibration applied thereto to obtain a dispersion. The dispersion was then dilluted with a 70/25/5 (by weight) mixture of xylene, cyclohexanone and isopropanol. The solution was then subjected to fine dispersion by a high pressure homogenizer (25° C., 300 kg/cm$^2$) to provide a lubricant concentration of 0.1% by weight. The coating was effected by a slide coating method to a thickness of 15 mg/m$^2$. The material was then dried at a temperature of 115° C. for 5 minutes. (It was confirmed that the inner temperature of the casing and the substantial temperature of the conveying roller in the conveying system had been 115° C.)

| | |
|---|---|
| n-$C_{17}H_{35}COOC_{30}H_{61}$-n | 4 parts by weight |
| n-$C_{30}H_{61}O(CH_2CH_2O)_{10}H$ | 1 part by weight |

5) Preparation of photographic material

Various layers having the following compositions were coated on the side of the undercoated support opposite the back layer to prepare a multi-layer color photographic light-sensitive material.

Composition of light-sensitive layer

The main materials to be incorporated in the various layers are classified as follows:

ExC: cyan coupler
ExM: magenta coupler
ExY: yellow coupler
ExS: sensitizing dye
UV: ultraviolet absorbent
HBS: high boiling organic solvent
H: gelatin hardener The figure attached to the various components indicates coated amount in g/m$^2$. For silver halide, it indicates coated amount as calculated in terms of silver. The coated amount of sensitizing dye is represented in molar amount based on mol of silver halide in the same layer.

| | |
|---|---|
| 1st layer (antihalation layer) | |
| Black colloidal silver | 0.18 in terms of silver |
| Gelatin | 1.40 |
| ExM-1 | 0.18 |
| ExF-1 | $2.0 \times 10^{-3}$ |
| HBS-1 | 0.20 |
| 2nd layer (interlayer) | |
| Silver bromoiodide emulsion G | 0.065 in terms of silver |
| 2,5-Di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| 3rd layer (low sensitivity red-sensitive emulsion layer) | |
| Silver bromoiodide emulsion A | 0.25 in terms of silver |
| Silver bromoiodide emulsion B | 0.25 in terms of silver |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-7 | 0.0050 |
| ExC-8 | 0.010 |
| Cpd-2 | 0.025 |
| HBS-1 | 0.10 |
| Gelatin | 0.87 |
| 4th layer (middle sensitivity red-sensitive emulsion layer) | |
| Silver bromoiodide emulsion D | 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.025 |
| ExC-7 | 0.0010 |
| ExC-8 | 0.0070 |
| Cpd-2 | 0.023 |
| HBS-1 | 0.10 |
| Gelatin | 0.75 |
| 5th layer (high sensitivity red-sensitive emulsion layer) | |
| Silver bromoiodide emulsion E | 1.40 in terms of silver |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| ExC-6 | 0.020 |

-continued

| | |
|---|---|
| ExC-8 | 0.025 |
| Cpd-2 | 0.050 |
| HBS-1 | 0.22 |
| HBS-2 | 0.10 |
| Gelatin | 1.20 |
| 6th layer (interlayer) | |
| Cpd-1 | 0.10 |
| HBS-1 | 0.50 |
| Gelatin | 1.10 |
| 7th layer (low sensitivity green-sensitive emulsion layer) | |
| Silver bromoiodide emulsion C | 0.35 in terms of silver |
| ExS-4 | $3.0 \times 10^{-5}$ |
| ExS-5 | $2.1 \times 10^{-4}$ |
| ExS-6 | $8.0 \times 10^{-4}$ |
| ExM-1 | 0.010 |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| 8th layer (middle sensitivity green-sensitive emulsion layer) | |
| Silver bromoiodide emulsion D | 0.80 in terms of silver |
| ExS-4 | $3.2 \times 10^{-5}$ |
| ExS-5 | $2.2 \times 10^{-4}$ |
| ExS-6 | $8.4 \times 10^{-4}$ |
| ExM-2 | 0.13 |
| ExM-3 | 0.030 |
| ExY-1 | 0.018 |
| HBS-1 | 0.16 |
| HBS-3 | $8.0 \times 10^{-3}$ |
| Gelatin | 0.90 |
| 9th layer (high sensitivity green-sensitive emulsion layer) | |
| Silver bromoiodide emulsion E | 1.25 in terms of silver |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.44 |
| 10th layer (yellow filter layer) | |
| Yellow colloidal silver | 0.030 in terms of silver |
| Cpd-1 | 0.16 |

-continued

| | |
|---|---|
| HBS-1 | 0.60 |
| Gelatin | 0.60 |
| 11th layer (low sensitivity blue-sensitive emulsion layer) | |
| Silver bromoiodide emulsion C | 0.18 in terms of silver |
| ExS-7 | $8.6 \times 10^{-4}$ |
| ExY-1 | 0.020 |
| ExY-2 | 0.22 |
| ExY-3 | 0.50 |
| ExY-4 | 0.020 |
| HBS-1 | 0.28 |
| Gelatin | 1.10 |
| 12th layer (middle sensitivity blue-sensitive emulsion layer) | |
| Silver bromoiodide emulsion D | 0.40 in terms of silver |
| ExS-7 | $7.4 \times 10^{-4}$ |
| ExC-7 | $7.0 \times 10^{-3}$ |
| ExY-2 | 0.050 |
| ExY-3 | 0.10 |
| HBS-1 | 0.050 |
| Gelatin | 0.78 |
| 13th layer (high sensitivity blue-sensitive emulsion layer) | |
| Silver bromoiodide emulsion F | 1.00 in terms of silver |
| ExS-7 | $4.0 \times 10^{-4}$ |
| ExY-2 | 0.10 |
| ExY-3 | 0.10 |
| HBS-1 | 0.070 |
| Gelatin | 0.86 |
| 14th layer (1st protective layer) | |
| Silver bromoiodide emulsion G | 0.20 in terms of silver |
| UV-4 | 0.11 |
| UV-5 | 0.17 |
| HBS-1 | $5.0 \times 10^{-2}$ |
| Gelatin | 1.00 |
| 15th layer (2nd protective layer) | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, in order to improve preservability, processability, pressure resistance, mildewproofing properties, antibacterial properties, antistatic properties and coatability, W-1 to W-3, B-4 to B-6, and F-1 to F-17, and iron, lead, gold, platinum, iridium and rhodium salts were properly incorporated in the various layers.

TABLE 3

| Emulsion | Average AgI Content (%) | Average Grain Diameter (μm) | Grain Diameter Fluctuation Coefficient (%) | Diameter/ Thickness Ratio | Silver Content Ratio [Core/Interlayer/Shell] (AgI Content) | Grain Structure/Shape |
|---|---|---|---|---|---|---|
| A | 4.0 | 0.45 | 27 | 1 | [1/3] (13/1) | Double Structure/ Octahedron |
| B | 8.9 | 0.70 | 14 | 1 | [3/7] (25/2) | Double Structure/ Octahedron |
| C | 2.0 | 0.55 | 25 | 7 | — | Uniform Structure/ Tabular |
| D | 9.0 | 0.65 | 25 | 6 | [12/59/29] (0/11/8) | Triple Structure/ Tabular |
| E | 9.0 | 0.85 | 23 | 5 | [8/59/33] (0/11/8) | Triple Structure/ Tabular |
| F | 14.5 | 1.25 | 25 | 3 | [37/63] (34/3) | Double Structure/ Tabular |
| G | 1.0 | 0.07 | 15 | 1 | — | Uniform Structure/ |

TABLE 3-continued

| Emulsion | Average AgI Content (%) | Average Grain Diameter (μm) | Grain Diameter Fluctuation Coefficient (%) | Diameter/ Thickness Ratio | Silver Content Ratio [Core/Interlayer/Shell] (AgI Content) | Grain Structure/Shape |
|---|---|---|---|---|---|---|
| | | | | | | Finely divided Grain |

In Table 3, (1) Emulsions A to F were subjected to reduction sensitization with thiourea dioxide and thiosulfonic acid during the grain formation in accordance with an example in JP-A-2-191938;

(2) Emulsions A to F were subjected to gold sensitization, sulfur sensitization and selenium sensitization in the presence of the spectral sensitizing dye as set forth with reference to the various light-sensitive layers and sodium thiocyanate in accordance with an example in JP-A-3-237450;

(3) The preparation of tabular grains was conducted with the use of a low molecular gelatin in accordance with JP-A-1-158426; and (4) The tabular grains and normal crystal grains having a grain structure were observed under a high voltage electron microscope to exhibit a transition line as described in JP-A-3-237450.

The structural formula of the couplers and various additives incorporated in the photographic light-sensitive material will be given below:

ExC-1

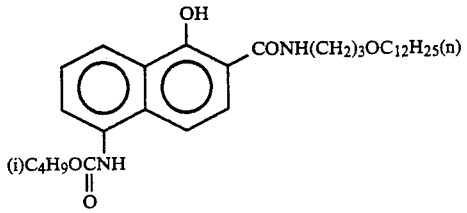

ExC-2

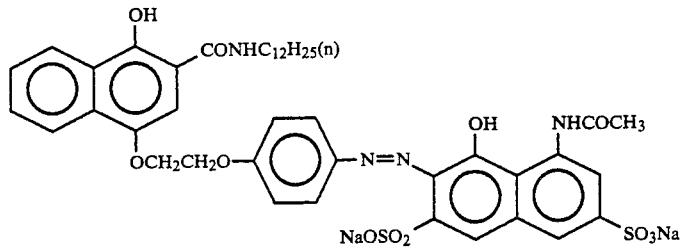

ExC-3

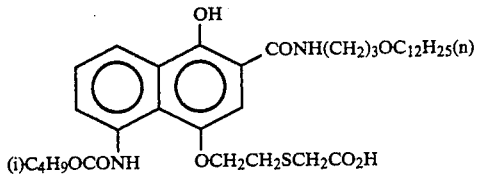

ExC-4

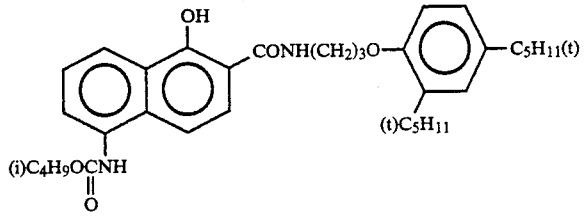

-continued
ExC-5
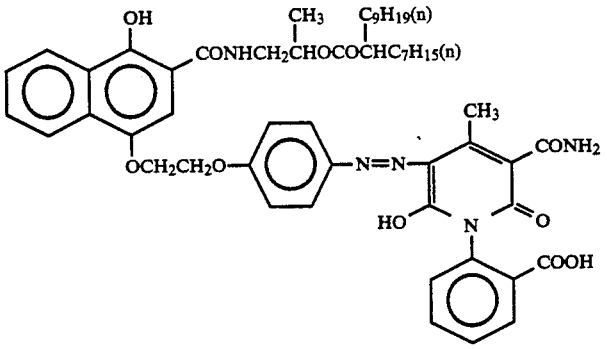
ExC-6
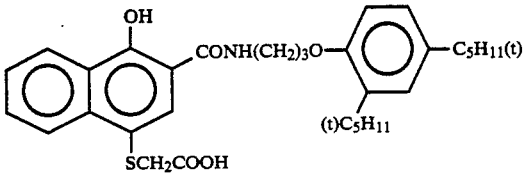
ExC-7
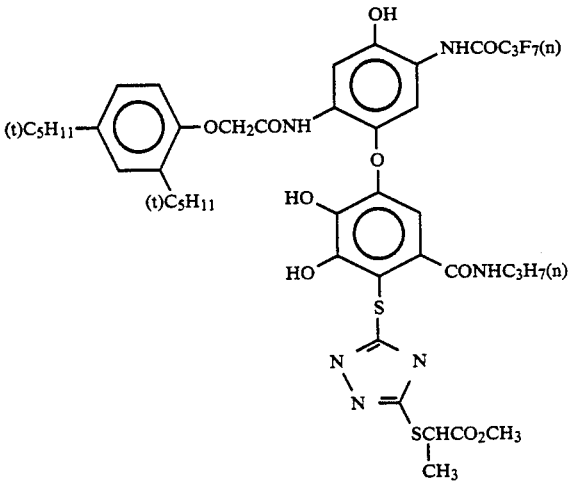
ExC-8
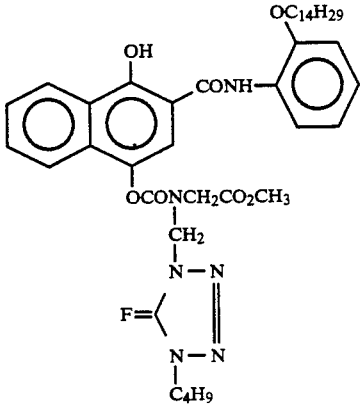

-continued
ExM-1
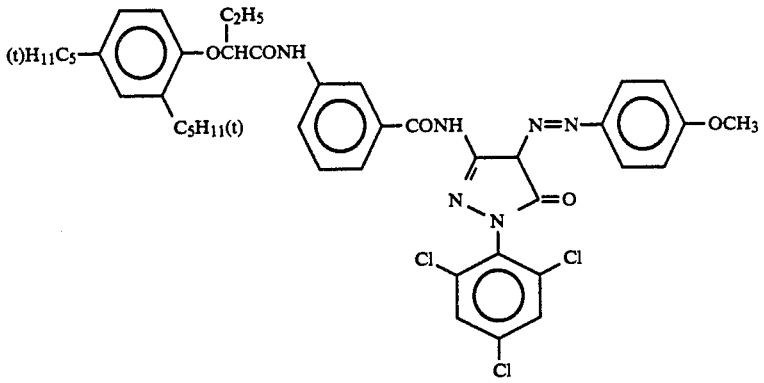
ExM-2
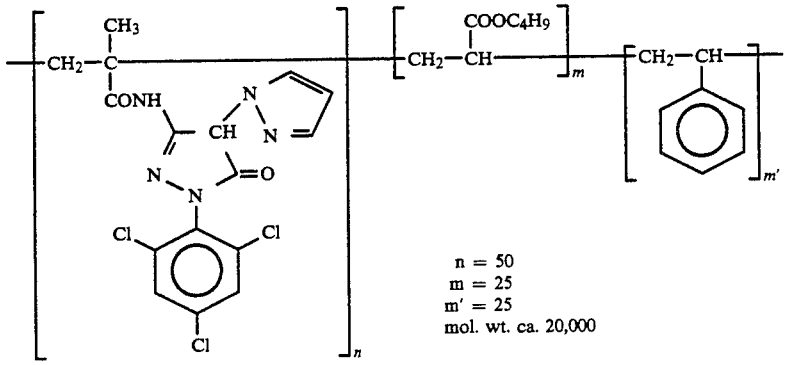
ExM-3
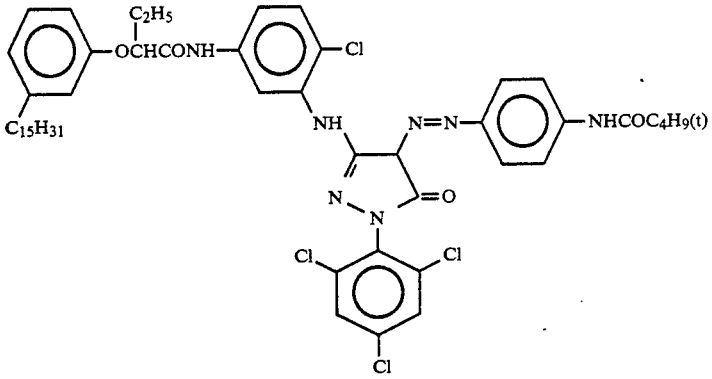
ExM-4
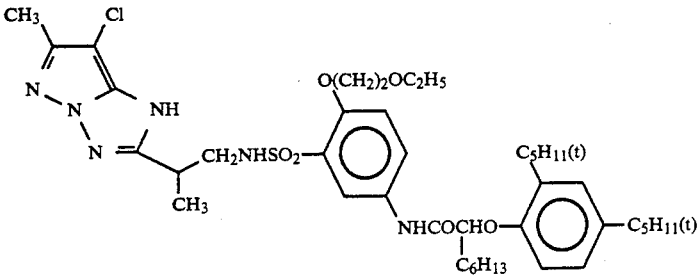

-continued
ExM-5
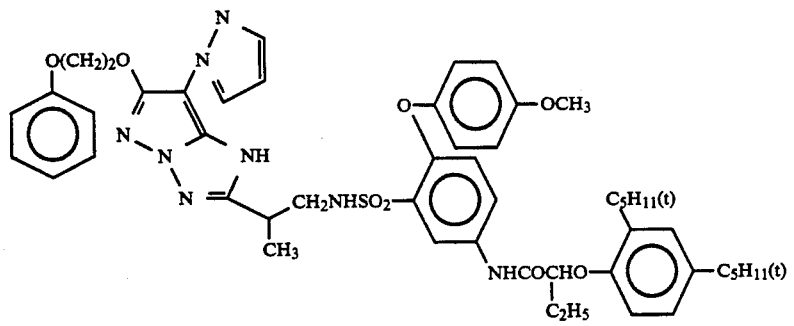
ExY-1
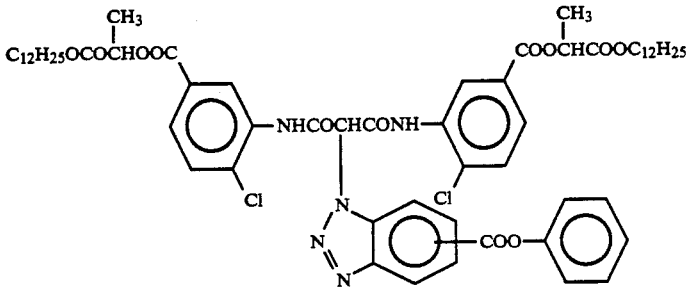
ExY-2
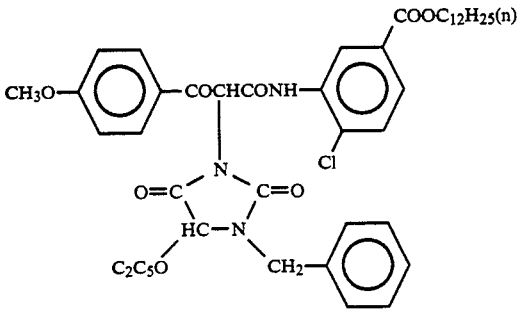
ExY-3
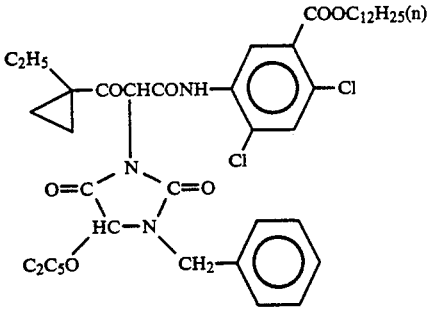
ExY-4
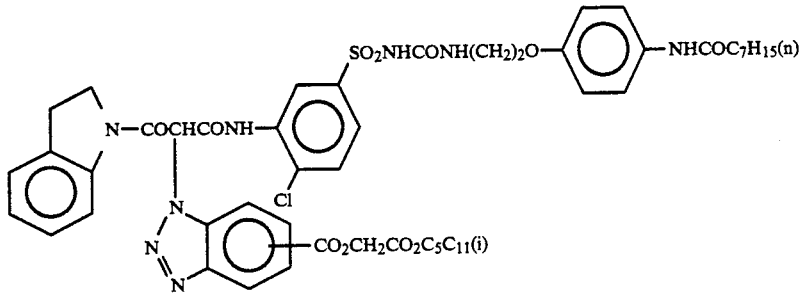

-continued
ExF-1
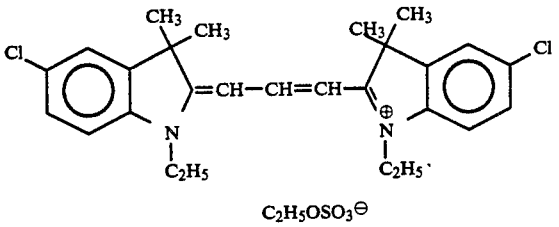
Cpd-1
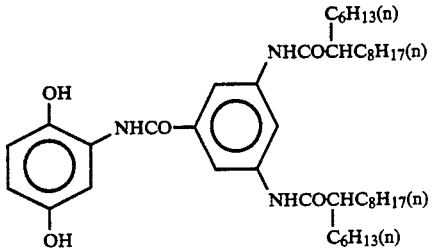
Cpd-2
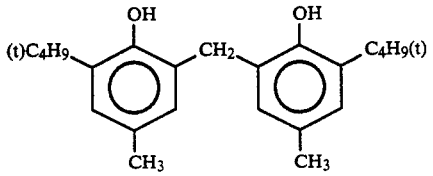
Cpd-3
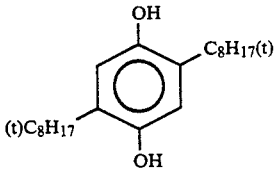
UV-1
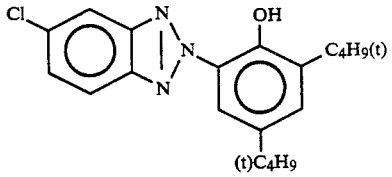
UV-2
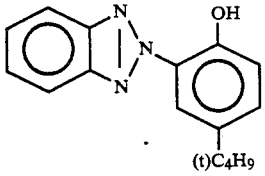
UV-3
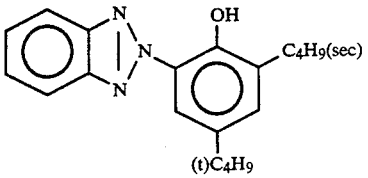

-continued
UV-4
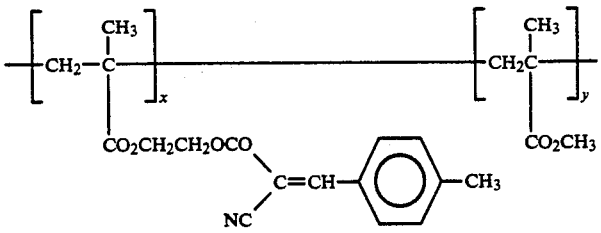
x:y = 70:30 (wt %)
UV-5
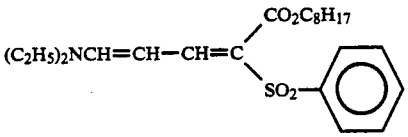
Tricresyl Phosphate
Di-n-butyl Phthalate
HBS-1
HBS-2
HBS-3
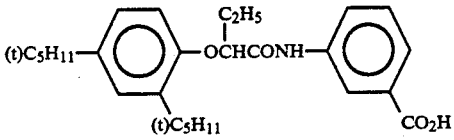
ExS-1
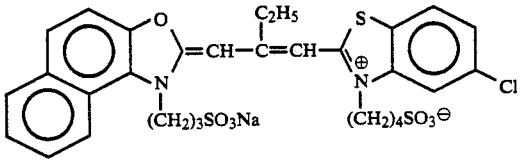
ExS-2
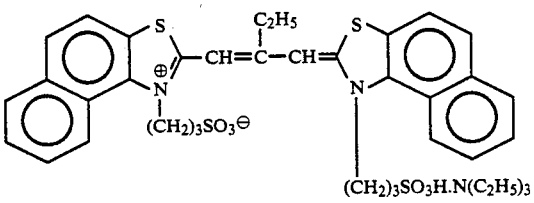
ExS-3
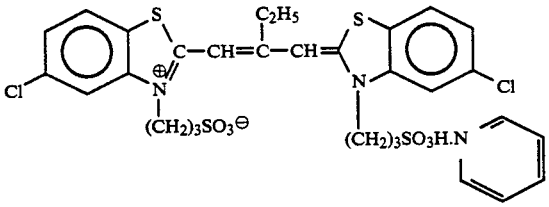
ExS-4
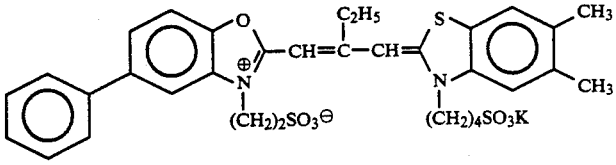
ExS-5
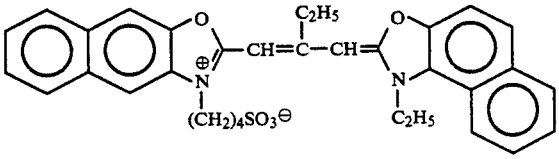

-continued
ExS-6
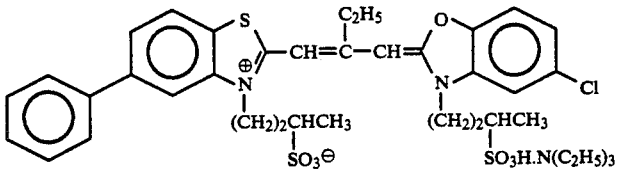
ExS-7
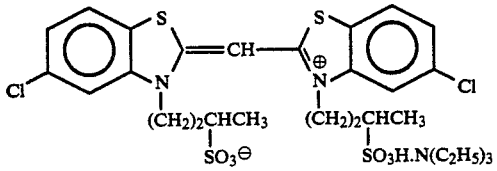
S-1
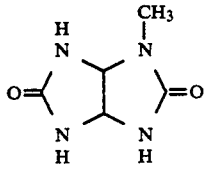
H-1
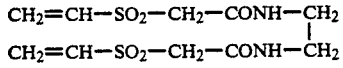
B-1
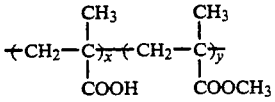
x/y = 10/90
B-2
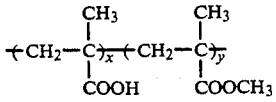
x/y = 40/60
B-3
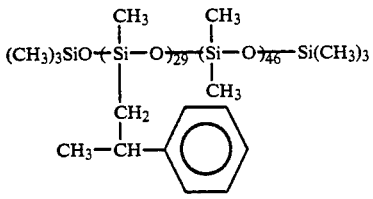
B-4
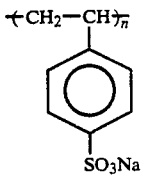
B-5
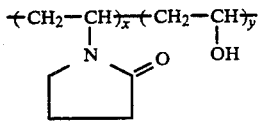
x/y = 70/30
B-6
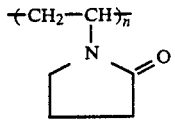
(mol. wt. about 10,000)

-continued
W-1
$C_8F_{17}SO_2NHCH_2CH_2CH_2OCH_2CH_2\overset{\oplus}{N}(CH_3)_3$
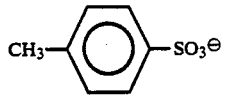
W-2
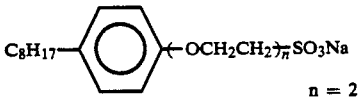
n = 2 ~ 4
W-3
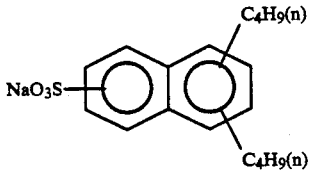
F-1
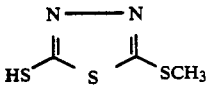
F-2
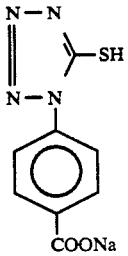
F-3
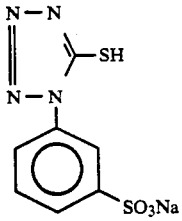
F-4
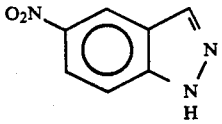
F-5
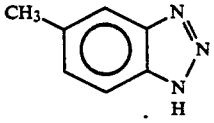
F-6
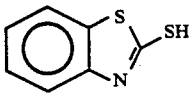
F-7
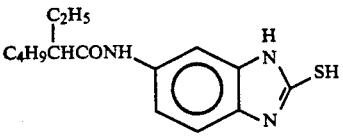

-continued

F-8

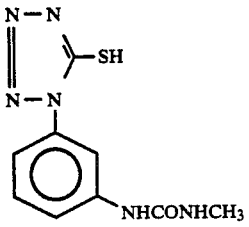

F-9

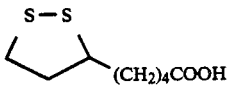

F-10

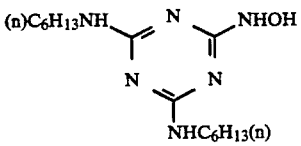

F-11

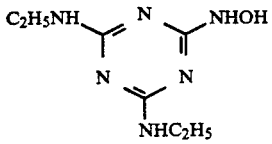

F-12

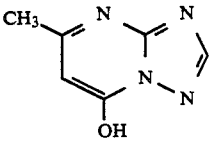

F-13

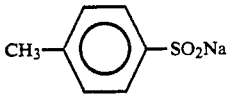

F-14

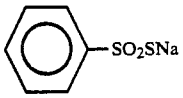

F-15

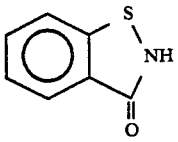

F-16

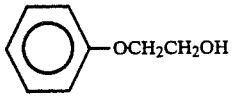

F-17

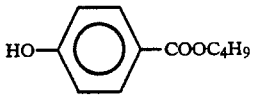

Results of Evaluation

The results are set forth in Table 2. Specimens A-1 and B-1, which have been prepared from PEN and PET, respectively, free from heat treatment, exhibits a relatively high degree of curl. Referring to the case where PEN is heat-treated, Specimens A-2 and A-4, which have been heat-treated at a temperature of from 50° C. to lower than Tg of PEN, exhibits a sufficiently low degree of curl while Specimens A-3 and A-5, which have been heat-treated at a temperature of higher than Tg of PEN or lower than 50° C., exhibits a relatively high degree of curl and thus cannot enjoy the heat treatment effect of the present invention.

On the other hand, referring to the case where PET is heat treated, Specimen B-2, which has been heat treated at a temperature of 50° C., enjoys some of the heat treatment effect on curl. However, Specimen B-3, which has ben heat treated at a temperature of 80° C., which is an expected internal temperature of car in the summerseason, shows no reduction of curl.

It can be also seen that the supports which have been subjected to glow discharge treatment exhibit an excellent adhesion on both the emulsion layer and back layer. Further, the specimens of the present invention comprising an electrically conductive layer exhibits excellent anstatic properties after development while Specimen A-7, which has been formed free of such an electrically conductive layer, exhibits poor antistatic properties.

EXAMPLE 2

1) Preparation of support

Pellets of PEN, PET, PAr, PCT, and polyester copolymers shown in Table 4 were each previously dried at a temperature of 150° C. for 4 hours. These materials were extruded through a biaxial kneading extruder at a temperature of 280° C. singly or in mixing proportions as set forth in Table 4, and then pelletized. To 100 parts by weight of the polyesters were each then added a dye Diaresin (available from Mitsubishi Chemical Industries Ltd.) in such an amount that the polyester film having a thickness of 85 μm exhibits an absorbance of 0.05 at 400 nm. The materials were each then dried by an ordinary method. The materials were each molten at a temperature of 300° C., extruded through a T-die, lengthwise oriented at a temperature of Tg+30° C. by a factor of 3.3, crosswise oriented at a temperature of Tg+20° C. by a factor of 3.3, and then heat-fixed at a temperature of 250° C. for 6 seconds to obtain films having thicknesses as shown in Table 4 as References 1 to 23.

2) Surface treatment of support

A glow discharge treatment was effected in the same manner as in Example 1 except that the temperature shortly before the passage of the film by the electrodes was 115° C. A corona discharge treatment was effected as follows. A 30-cm wide support was treated by means of 6KVA model of solid-state corona treatment machine available from Pillar for 20 m/min. With the reading of current and voltage, the object was treated at 0.375 KV·A·min/m². The discharge frequency during treatment was 9.6 KHz. The gap clearance between the electrode and the dielectric roll was 1.6 mm.

3) Evaluation of blocking resistance of base after discharge treatment

The base was subjected to glow discharge treatment or corona discharge treatment, wound in the form of roll with a tension of 70 g applied per a width of 1 cm, and then allowed to stand for 1 day. The specimen was then evaluated for blocking resistance. Those showing no blocking were evaluated as excellent (E) while those showing blocking were evaluated as poor (P).

4) Undercoating layer, emulsion layer and back layer

The undercoating layer, emulsion layer and back layer were provided in the same manner as in Example 1.

The photographic films thus prepared were each wound around a spool having an outer diameter of 11 mm and then evaluated for rear end break upon development and adhesion in the same manner as in Example 1.

5) Results

The results are set forth in Table 4.

TABLE 4

| Reference | Support described herein Composition ratio of blend (wt/wt %) PEN/PET/PAr/PCT | Thickness (μm) | Tg (°C.) | X: Glow discharge treatment Y: Corona discharge treatment | Blocking resistance of base after discharge treatment | Film rear end break after development | Adhesion Dry | Adhesion Wet | Remarks |
|---|---|---|---|---|---|---|---|---|---|
| 1 | PEN | 85 | 119 | X | E | F | A | A | Present invention |
| 2 | PEN | 85 | 119 | Y | E | F | D | D | Comparative |
| 3 | PBB-2 = 80/20/0/0 | 85 | 104 | X | E | F | A | A | Present invention |
| 4 | 75/0/0/25 | 75 | 122 | X | E | F | A | A | Present invention |
| 5 | PBB-3 = 50/0/50/0 | 70 | 142 | X | E | E | A | A | Present invention |
| 6 | 40/60/0/0 | 110 | 91 | X | E | F | A | A | Present invention |
| 7 | 40/60/0/0 | 110 | 91 | Y | E | F | D | D | Comparative |
| 8 | 25/75/0/0 | 120 | 83 | X | P | P | A | A | Comparative |
| 9 | PBB-6 = 50/25/25/0 | 85 | 108 | X | E | F | A | A | Present invention |
| 10 | PBB-4 = 0/0/50/50 | 60 | 118 | X | E | F | A | A | Present invention |
| 11 | PBB-5 = 0/40/60/0 | 90 | 101 | X | E | F | A | A | Present invention |
| 12 | PET | 90 | 69 | X | P | P | B | B | Comparative |
| 13 | PCT | 85 | 93 | X | E | F | A | A | Present invention |
| 14 | PCT | 85 | 93 | Y | E | F | D | D | Comparative |
| 15 | PAr | 85 | 192 | X | E | E | A | A | Present invention |
| 16 | PAr | 85 | 192 | Y | E | E | D | D | Comparative |
| 17 | PBC-1 | 85 | 92 | X | E | F | A | A | Present invention |
| 18 | PBC-3 | 70 | 112 | X | E | F | A | A | Present invention |
| 19 | PBC-3 | 70 | 112 | Y | E | F | D | D | Comparative |
| 20 | PBC-5 | 85 | 135 | X | E | E | A | A | Present invention |
| 21 | PBC-7 | 85 | 95 | X | E | F | A | A | Present invention |
| 22 | PBC-8 | 75 | 105 | X | E | F | A | A | Present invention |
| 23 | PBC-10 | 65 | 125 | X | E | F | A | A | Present invention |

References 1, 6, 13, 15 and 18 of the present invention, which have been prepared from a glow discharged polyester support having a glass transition temperature of 90° C. to 200° C., exhibit an excellent adhesion while References 2, 7, 14, 16 and 19, which have been prepared from the same polyester support free from glow discharge treatment, exhibit a poor adhesion. It can also be seen that Reference 8, which has been prepared from a polyester support having a glass transition temperature of not higher than 90° C., exhibits an excellent adhesion but shows a deteriorated blocking resistance of base after discharge treatment and a significant film rear end break upon development. It can further be seen that Reference 12 exhibits a reduced blocking resistance of base after discharge treatment and a significant film rear end break upon development.

EXAMPLE 3

1) Preparation of support

Supports A-1 to A-17, and B to G were prepared as follows:

Support A: To 100 parts by weight of a commercially available polyethylene-2,6-naphthalate polymer was added a dye Diaresin (available from Mitsubishi Chemical Industries Ltd.) in such an amount that the film having a thickness of 80 μm exhibits an absorbance of 0.05 at 400 nm. The material was then dried by an ordinary method. The material was molten at a temperature of 300° C., extruded through a T-die, lengthwise oriented at a temperature of 140° C. by a factor of 3.3, crosswise oriented at a temperature of 130° C. by a factor of 3.3, and then heat-fixed at a temperature of 250° C. for 6 seconds to obtain films having thicknesses of 55 μm, 60 μm and 80 μm.

Support B: A commercially available polyethylene terephthalate polymer was biaxially oriented by an appropriate method to obtain a film having a thickness of 90 μm.

Supports C, D, E, F, G: The concentration of the dye to be incorporated was the same as that in Supports A. The materials were each dried, molten at a temperature of 300° C., extruded through a T-die, lengthwise oriented at a temperature of Tg+30° C. by a factor of 3.3, crosswise oriented at a temperature of Tg+20° C. by a-factor of 3.3, and then heat-fixed at a temperature of 250° C. for 6 seconds to obtain films having thicknesses as set forth in Table 5-1.

2) Heat treatment of support

Supports A-1 to A-17 and B to G thus prepared were then subjected to preheat treatment and post heat treatment under the conditions as set forth in Table 5-1, followed by the surface treatment as mentioned below.

3) Surface treatment of support

The $H_2O$ partial pressure in the atmospheric gas for glow discharge treatment and the film preheating temperature were controlled as set forth in Table 5-1. The pressure in the vacuum tank and the discharge frequency, voltage and intensity were the same as used in Example 1.

4) Preparation of Photographic Material

The preparation of undercoating solutions for Supports A-1 to A-13, A-15 to A-17, B to G, the coating of antistatic layer, back layer and slip layer, and the preparation of photographic materials were conducted in the same manner as in Example 1. For A-14, a solution free of dispersion of electrically conductive grains was coated instead of antistatic layer.

5) Evaluation of photographic film

Photographic film specimens A-1 to A-17, and B to G thus prepared were evaluated for curl, gutter-shaped curl, pressure marking, dry and wet adhesion, static mark and dustproofing properties.

6) Results

The results are set forth in Table 5-2.

TABLE 5-1

| | | | | Preheat treatment | | | Surface treatment | |
|---|---|---|---|---|---|---|---|---|
| Reference | Support | Thickness (μm) | Tg (°C.) | Temperature (°C.) | Time (min.) | Post heat treatment | $H_2O$ Partial pressure in glow discharge treatment | Base preheat treatment temperature before glow discharge treatment (°C.) |
| A-1 | PEN | 80 | 119 | 150 | 5 | 110° C. - 1 day | Untreated | 115 |
| A-2 | " | " | " | 150 | 5 | 110° C. - 1 day | 5 | 115 |
| A-3 | " | " | " | 150 | 5 | 110° C. - 1 day | 10 | 115 |
| A-4 | " | " | " | 150 | 5 | 110° C. - 1 day | 50 | 115 |
| A-5 | " | " | " | 150 | 5 | 110° C. - 1 day | 80 | 115 |
| A-6 | " | " | " | Untreated | | 110° C. - 1 day | 80 | 115 |
| A-7 | " | " | " | 150 | 5 | Gradually cooled at −1° C./min from 130° C. to 80° C. | 80 | 40 |
| A-8 | " | " | " | 150 | 5 | Gradually cooled at −1° C./min from 130° C. to 80° C. | 80 | 50 |
| A-9 | " | " | " | 150 | 5 | Gradually cooled at −1° C./min from 130° C. to 80° C. | 80 | 115 |
| A-10 | " | " | " | 150 | 5 | Gradually cooled at −1° C./min from 130° C. to 80° C. | 80 | 125 |
| A-11 | " | " | " | Untreated | | Gradually cooled at −1° C./min from 130° C. to 80° C. | 80 | 115 |
| A-12 | " | 55 | " | 150 | 5 | Gradually cooled at −1° C./min from 130° C. to 80° C. | 80 | 115 |
| A-13 | PEN | 60 | 119 | 150 | 5 | Gradually cooled at −1° C./min from 130° C. to 80° C. | 80 | 115 |
| A-14 | " | 80 | " | 150 | 5 | 130° C. - 1 day | 80 | 115 |
| A-15 | " | " | " | 150 | 5 | Gradually cooled at −1° C./min from 130° C. to 80° C. | 80 | 115 |
| A-16 | " | " | " | 150 | 5 | Gradually cooled at −1° C./min from 130° C. to 80° C. | 80 | 115 |
| A-17 | " | " | " | 150 | 5 | Gradually cooled at −1° C./min from 130° C. to 80° C. | 80 | 115 |
| B | PET | 90 | 69 | 120 | 5 | 60° C. - 1 day | 80 | 115 |
| C | PBC-1 | 110 | 92 | 150 | 5 | 110° C. - 1 day | 70 | 80 |
| D | PBC-5 | 80 | 135 | " | 60 | 110° C. - 1 day | 70 | 125 |
| E | PBC-8 | 90 | 105 | " | 5 | 110° C. - 1 day | 70 | 90 |
| F | PBB-1 | 100 | 95 | " | 5 | 110° C. - 1 day | 70 | 80 |
| G | PBB-3 | 70 | 142 | 160 | 60 | 110° C. - 1 day | 70 | 130 |

TABLE 5-2

| Reference | Gutter-shaped curl | Pressure marking | Spool diameter (mm) | Film rear end break after development | Adhesion Dry | Adhesion Wet | Static mark | Dust attraction | Remarks |
|---|---|---|---|---|---|---|---|---|---|
| A-1 | E | E | 7 | Untreatable | D | D | A | A | Comparative |
| A-2 | " | " | 7 | E | B | B | A | A | Present invention |
| A-3 | " | " | 7 | E | A | B | A | A | Present invention |
| A-4 | " | " | 7 | E | A | A | A | A | Present invention |
| A-5 | " | " | 7 | E | A | A | A | A | Present invention |
| A-6 | " | " | 7 | F | A | A | A | A | Present invention |
| A-7 | " | " | 7 | E | C | B | A | A | Present invention |
| A-8 | " | " | 7 | E | A | A | A | A | Present invention |
| A-9 | " | " | 7 | E | A | A | A | A | Present invention |
| A-10 | " | " | 7 | F | B | B | A | A | Present invention |
| A-11 | " | " | 7 | F | A | A | A | A | Present invention |
| A-12 | P | " | 7 | E | A | A | A | A | Present invention |
| A-13 | E | " | 7 | E | A | A | A | A | Present invention |
| A-14 | " | " | 7 | F | A | A | D | D | Present invention |
| A-15 | " | " | 11 | E | A | A | A | A | Present invention |
| A-16 | " | " | 5 | E | A | A | A | A | Present invention |
| A-17 | E | P | 4 | P | A | A | A | A | Present invention |
| B | " | E | 7 | P | B | B | A | A | Comparative |
| C | " | " | 9 | E | A | A | A | A | Present invention |
| D | " | " | 7 | E | A | A | A | A | Present invention |
| E | " | " | 7 | E | A | A | A | A | Present invention |
| F | " | " | 9 | E | A | A | A | A | Present invention |
| G | " | " | 7 | E | A | A | A | A | Present invention |

i. Effect of glow discharge treatment of support on adhesion

Reference A-1, which has been prepared from a PEN support having a glass transition temperature of 119° C. free from glow discharge treatment, exhibits a poor adhesion while References A-2 to A-5, which have been prepared from the same PEN support that had been glow discharged, exhibit a practically insignificant problem in adhesion.

It can be seen from References A-2 to A-5 that when the $H_2O$ partial pressure is 5%, the adhesion is practically excellent, and as the $H_2O$ partial pressure increases, the adhesion is further improved.

It can also be seen from References A-7 to A-10 that when the base preheat treatment temperature before glow discharge treatment is from 50° C. to 119° C., which is the glass transition temperature of PEN, it provides a fairly excellent adhesion while the adhesion is slightly deteriorated when the preheat treatment temperature falls below 50° C. or exceeds 119° C.

ii. Effect of the glass transition temperature of support on curl

The specimens which have been prepared from a PEN support having a glass transition temperature of 119° C. are insusceptible to film rear end break upon processing. On the other hand, the specimens which have been prepared from a PET support having a glass transition temperature of 69° C. is susceptible to film rear end break upon processing. It can also be seen that the specimens which have been prepared from the polymer supports C to G having Tg of from 90° C. to 200° C. that had been glow discharged, exhibit an excellent adhesion as well as little or no curl.

iii. Effect of preheat treatment at the glass transition temperature of support or higher and post heat treatment at the glass transition temperature or lower on curl It can be seen that References 6 and 11, which have been free from preheat treatment, exhibit some degree of curl as compared with References 5 and 9, which have been prepared with preheat treatment. It can also be seen that Reference 14, which has been prepared with post heat treatment at a temperature of not lower than Tg of PEN, exhibits some degree of curl as compared with References 5 and 9, which have been prepared with post heat treatment at a temperature of not higher than Tg of PEN.

iv. Effect of support thickness and spool diameter

Reference 12, which has been prepared from a PEN support having a thickness of less than 60 μm, shows a gutter-shaped curl while those which have been prepared from a PEN support having a thickness of more than 60 μm, show no gutter-shaped curl. Further, Reference A-17, which has been wound around a spool having an outer diameter of less than 5 mm, exhibits worsened pressure marking and curl. It can be thus seen that the specimens of the present invention which have been prepared from a support having a thickness of not less than 60 μm and wound around a spool having an outer diameter of 5 mm or more are significantly insusceptible to curling and pressure marking.

v. Effect of antistatic layer comprising metal oxides on static mark and dustproofing properties As compared to References A-1 to A-13, and A-15 to A-17 of the present invention, which exhibit a volume resisitivity of about $1\times10^9$ Ω, Reference A-14, which has been prepared free of metal oxides, exhibits a volume resisitivity of $1\times10^{15}$ Ω or more and thus exhibits poor antistatic properties under low humidity conditions (25° C., 10% RH) and significant static marking and dust attraction. Thus, it can be seen that the use of a metal oxide of the present invention having a volume resisitivity of $10^7$ Ω/cm or less can provide excellent antistatic properties.

As mentioned above, the glow discharge treatment according to the present invention can provide a silver halide photographic material which exhibits an excellent adhesion between the support and the emulsion layer and back layer, can be hardly curled and is insusceptible to rear end break upon processing. The effect of inhibiting curl becomes remarkable when the thickness of the support is small. Accordingly, the present invention is effective particularly when the photographic film is wound around a spool having a small diameter. This results in a great advantage that the size of the cartridge around which the photographic film is wound can be reduced.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one light-sensitive layer on a polyester support, wherein said polyester support has a glass transition temperature of 90° C. to 200° C. and has been subjected to glow discharge treatment; wherein said polyester support comprises a polyester containing naphthalenedicarboxylic acid and ethylene glycol as main components.

2. The silver halide photographic material according to claim 1, wherein said polyester support is subjected to heat treatment (1) at a temperature ranging from 50° C. to lower than the glass transition temperature of said polyester support before the glow discharge treatment.

3. The silver halide photographic material according to claim 1, wherein the water content of the gas composition in the atmosphere for glow discharge treatment is not less than 10%.

4. The silver halide photographic material according to claim 3, wherein said polyester support is subject to the glow discharge treatment after being preheated at a temperature ranging from 50° C. to the glass transition temperature of said polyester support.

5. The silver halide photographic material according to claim 2, wherein said polyester support is subjected to heat treatment (2) at a temperature of not less than the glass transition temperature of said polyester support before said heat treatment (1).

6. The silver halide photographic material according to claim 1, wherein the molar proportion of naphthalenedicarboxylic acid to the amount of dicarboxylic acid other than naphthalenedicarboxylic contained in the polyester is 0.3:0.7 to 1.0:0.

7. The silver halide photographic material according to claim 1, wherein said photographic material has at least one electrically conductive layer on at least one side thereof and the electrically conductive material constituting said electrically conductive layer comprises at least one selected from the group consisting of metal oxides comprising Zn, Ti, Sn, Al, In, Si, Mg, Ba, Mo, W, and V as main components and having a volume resistivity of $10^7$ Ω/cm or less.

8. The silver halide photographic material according to claim 1, wherein said photographic material is wound around a spool having an outer diameter of 5 mm to 11 mm in the form of roll.

9. The silver halide photographic material according to claim 1, wherein said polyester support is polyethylene-2,6-naphthalenedicarboxylate.

* * * * *